US008295737B2

(12) United States Patent
Tsuda et al.

(10) Patent No.: US 8,295,737 B2
(45) Date of Patent: Oct. 23, 2012

(54) DEVELOPING DEVICE AND IMAGE FORMING APPARATUS USING SAME

(75) Inventors: Kiyonori Tsuda, Kanagawa (JP); Junichi Terai, Kanagawa (JP); Keiko Matsumoto, Kanagawa (JP); Kentaroh Tomita, Kanagawa (JP); Kohichi Utsunomiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 944 days.

(21) Appl. No.: 12/019,984

(22) Filed: Jan. 25, 2008

(65) Prior Publication Data

US 2008/0187332 A1 Aug. 7, 2008

(30) Foreign Application Priority Data

Jan. 26, 2007 (JP) ..... 2007-016176
Jul. 27, 2007 (JP) ..... 2007-196352

(51) Int. Cl.
*G03G 15/08* (2006.01)

(52) U.S. Cl. ..... 399/254; 399/260

(58) Field of Classification Search ..... 399/254, 399/260

See application file for complete search history.

(56) References Cited

U.S. PATENT DOCUMENTS 7,132,210 B2 11/2006 Suzuki et al.
7,146,122 B2 12/2006 Hatori et al.
7,184,691 B2 2/2007 Kita et al.
7,315,715 B2 1/2008 Tsuda et al.
2005/0214670 A1 9/2005 Matsumoto et al.
2005/0250037 A1 11/2005 Sawada et al.
2005/0277046 A1 12/2005 Sawada et al.
2006/0083555 A1 4/2006 Uchiyama et al.
2006/0127152 A1 6/2006 Nagayama et al.
2006/0182466 A1* 8/2006 Oda et al. ..... 399/253
2006/0222987 A1 10/2006 Suzuki et al.
2007/0081835 A1 4/2007 Tsuda et al.
2007/0116494 A1 5/2007 Uno et al.
2007/0140747 A1 6/2007 Kita et al.
2007/0160392 A1 7/2007 Tsuda et al.
2007/0166074 A1 7/2007 Hosokawa et al.

(Continued)

FOREIGN PATENT DOCUMENTS

JP 5-127537 5/1993

(Continued)

OTHER PUBLICATIONS

U.S. Appl. No. 12/246,027, filed Oct. 6, 2008, Uno, et al.

(Continued)

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A developing device capable of preventing scattered developer from being discharged and of stably supplying a developer to a latent image carrier by preventing the developer from being discharged despite that the amount of developer within the developing device is not increased, and an image forming apparatus including the developing device. When the bulk of the developer existing in the vicinity of the downstream end in the conveyance direction of the supply conveyance path exceeds the height level of the developer discharge port, the developer that has reached the height level of the developer discharge port is discharged to the outside of the developing device by the developer discharge port and developer conveyance path serving as the developer discharge device.

15 Claims, 18 Drawing Sheets

U.S. PATENT DOCUMENTS

| | | | | |
|---|---|---|---|---|
| 2007/0177905 | A1 | 8/2007 | Hosokawa et al. | |
| 2007/0212119 | A1 | 9/2007 | Kurenuma et al. | |
| 2007/0264052 | A1 | 11/2007 | Yoshida et al. | |
| 2007/0264054 | A1* | 11/2007 | Tsuda et al. | 399/256 |
| 2007/0280742 | A1 | 12/2007 | Matsumoto et al. | |
| 2008/0008502 | A1* | 1/2008 | Hatakeyama et al. | 399/254 |
| 2008/0175628 | A1* | 7/2008 | Kita et al. | 399/262 |
| 2008/0181670 | A1 | 7/2008 | Tsuda et al. | |
| 2008/0181672 | A1* | 7/2008 | Hatakeyama et al. | 399/254 |
| 2009/0148193 | A1* | 6/2009 | Hatakeyama et al. | 399/254 |

FOREIGN PATENT DOCUMENTS

| | | |
|---|---|---|
| JP | 6-258930 | 9/1994 |
| JP | 10-228175 | 8/1998 |
| JP | 11-167260 | 6/1999 |
| JP | 2000-47474 | 2/2000 |
| JP | 2001-290369 | 10/2001 |
| JP | 2005-99134 | 4/2005 |
| JP | 2006-30276 | 2/2006 |

OTHER PUBLICATIONS

U.S. Appl. No. 12/250,046, filed Oct. 13, 2008, Tsuda.
U.S. Appl. No. 12/253,538, filed Oct. 17, 2008, Uno, et al.
U.S. Appl. No. 12/182,626, filed Jul. 30, 2008, Terai.
U.S. Appl. No. 12/235,135, filed Sep. 22, 2008, Kato, et al.
U.S. Appl. No. 12/238,815, filed Sep. 26, 2008, Utsunomiya, et al.

* cited by examiner

DEVELOPING DEVICE AND IMAGE FORMING APPARATUS USING SAME

BACKGROUND OF THE INVENTION

1. Field of the Invention

The present invention relates to a developing device used in a copying machine, a facsimile device, a printer and the like, and to an image forming apparatus using the developing device.

2. Description of the Related Art

There has conventionally been widely used an image forming apparatus with a developing device that uses a two-component developer consisting of toner and magnetic carrier. As this type of image forming apparatus, there is an image forming apparatus in which toner is replenished, according to need, from a toner container to a developer contained in a developing device that consumes toner as it conducts development, and thereby the toner density of the developer is maintained within a predetermined range. In such a configuration, because the carrier within the developer is repeatedly used without being consumed significantly, the coated layer on the surface layer of the carrier is worn when an image is output, or a toner resin or an additive is adhered to the coat layer. Consequently, the ability of the carrier to charge the toner decreases gradually, deteriorating the carrier. Toner charge amount decreases as the deterioration of the carrier progresses, causing scumming or toner scattering. Therefore, a serviceman is sent to the user of this type of image forming apparatus to replace the carrier regularly. For this reason, the maintenance cost and the cost per image formation increase.

Japanese Unexamined Patent Application No. 2005-292511 describes a developing device in which pre-mixed developer with a mixture of carrier and toner is replenished into a developer contained in the developing device to recover the toner density, and at the same time the increment of the developer is discharged from the developing device. In such a configuration, old carrier is discharged little by little from the developing device by discharging the developer, and at the same time new carrier within the pre-mixed developer is replenished to the developer contained in the developing device. Then, the carrier is replaced with new carrier little by little by performing the discharge and replenishment, whereby the carrier replacement work can be omitted.

Moreover, in this developing device, a developer discharge port for discharging the developer to the outside of the device is provided as developer discharge means at a predetermined height level of a supply conveyance path which conveys the developer in the axial direction of a developing roller while supplying the developer to the developing roller. In this developing device, when the pre-mixed developer is supplied and the amount of developer within the developing device increases, the developer bulk increases in the supply conveyance path. At this moment, the developer that has reached the height level of the developer discharge port in the position provided with the developer discharge port is discharged from the developer discharge port to the outside of the developing device.

However, in this developing device, the developer discharge port is provided in the middle of a developer supply region where the developer is supplied to the developing roller within the supply conveyance path. The developer conveyed within the supply conveyance path is scattered by its moving force or by the rotating force of a conveying member providing the developer with a conveying force when the conveying member is a conveying screw, and this developer is sometimes discharged from the developer discharge port.

When the developer scatters and is discharged, the scattered developer might be discharged even if the developer is conveyed within the supply conveyance path in appropriate amount or less. In this situation, the developer is discharged, despite that the amount of developer within the developing device is not increased. If the developer is discharged from the developer discharge port despite that the amount of developer is equal to or lower than the appropriate amount, the amount of developer within the developing device might fall below the necessary amount, destabilizing the supply of the developer to a latent image carrier. If the supply of the developer to the latent image carrier is destabilized, image omission and other abnormal images occur.

Such problems are not limited to a developing device that uses a two-component developer, and thus might occur in any developing device that uses a one-component developer, as long as such a developing device is configured such that a developer is replenished by developer replenishing means and then the increment of the developer within the developing device is discharged by developer discharge means.

Technologies relating to the present invention are also disclosed in, e.g., Japanese Unexamined Patent Application No. H05-127537, Japanese Unexamined Patent Application No. H06-258930, Japanese Unexamined Patent Application No. 2000-047474, and Japanese Unexamined Patent Application No. 2001-290369.

SUMMARY OF THE INVENTION

The present invention was contrived in view of the above problems, and an object of the present invention is to provide a developing device capable of preventing scattered developer from being discharged and of stably supplying a developer to a latent image carrier by preventing the developer from being discharged despite that the amount of developer within the developing device is not increased, and to also provide an image forming apparatus using the developing device.

In an aspect of the present invention, a developing device comprises a developer carrier, which rotates while carrying a developer on a surface thereof, supplies a toner to a latent image on a surface of a latent image carrier at a section where the developer carrier faces the latent image carrier, and develops the latent image; a developer replenishing device for replenishing the developer to the developing device; a supply conveyance path, which has a supply conveying member that conveys the developer in an axis line direction of the developer carrier while supplying the developer to the developer carrier; a circulation conveyance path, which has a circulation conveying member that conveys the developer reaching a downstream end in a conveyance direction of the supply conveyance path to an upstream end in the conveyance direction of the supply conveyance path; and a developer discharge device for discharging part of the developer existing in the vicinity of the downstream end in the conveyance direction of the supply conveyance path, when the bulk of the developer existing in the vicinity of the downstream end in the conveyance direction of the supply conveyance path exceeds a predetermined height level.

In another aspect of the present invention, an image forming apparatus comprises at least a latent image carrier; a charging device for charging a surface of the latent image carrier; a latent image forming device for forming an electrostatic latent image on the latent image carrier; and a developing device for developing the electrostatic latent image to form a toner image. The developing means comprises a developer carrier, which rotates while carrying a developer on a surface thereof, supplies a toner to a latent image on a surface of a latent image carrier at a section where the developer carrier faces the latent image carrier, and develops the latent image; a developer replenishing device for replenishing the developer to the developing device; a supply conveyance path, which has a supply conveying member that conveys the developer in an axis line direction of the developer carrier while supplying the developer to the developer carrier; a circulation conveyance path, which has a circulation conveying member that conveys the developer reaching a downstream end in a conveyance direction of the supply conveyance path to an upstream end in the conveyance direction of the supply conveyance path; and a developer discharge device for discharging part of the developer existing in the vicinity of the downstream end in the conveyance direction of the supply conveyance path, when the bulk of the developer existing in the vicinity of the downstream end in the conveyance direction of the supply conveyance path exceeds a predetermined height level.

In another aspect of the present invention, a developing device comprises a developer carrier, which rotates while carrying a developer on a surface thereof, supplies a toner to a latent image on a surface of a latent image carrier at a section where the developer carrier faces the latent image carrier, and develops the latent image; a developer replenishing device for replenishing the developer to the developing device; a supply conveyance path, which has a supply conveying member that conveys the developer in an axis line direction of the developer carrier while supplying the developer to the developer carrier; a circulation conveyance path, which has a circulation conveying member that conveys the developer reaching a downstream end in a conveyance direction of the supply conveyance path to an upstream end in the conveyance direction of the supply conveyance path; and a developer conveyance amount regulating device for regulating the amount of the developer that passes through a developer discharge port for discharging part of the developer within the developer conveyance paths having the supply conveyance path and circulation conveyance path to the outside of the developer conveyance paths, and that through regulating positions within the developer conveyance paths. The developer discharge port is disposed such that accumulated developer that is regulated by the developer conveyance amount regulating device is discharged from the developer discharge port when the amount of the accumulated developer exceeds a predetermined amount.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

Figure 1:
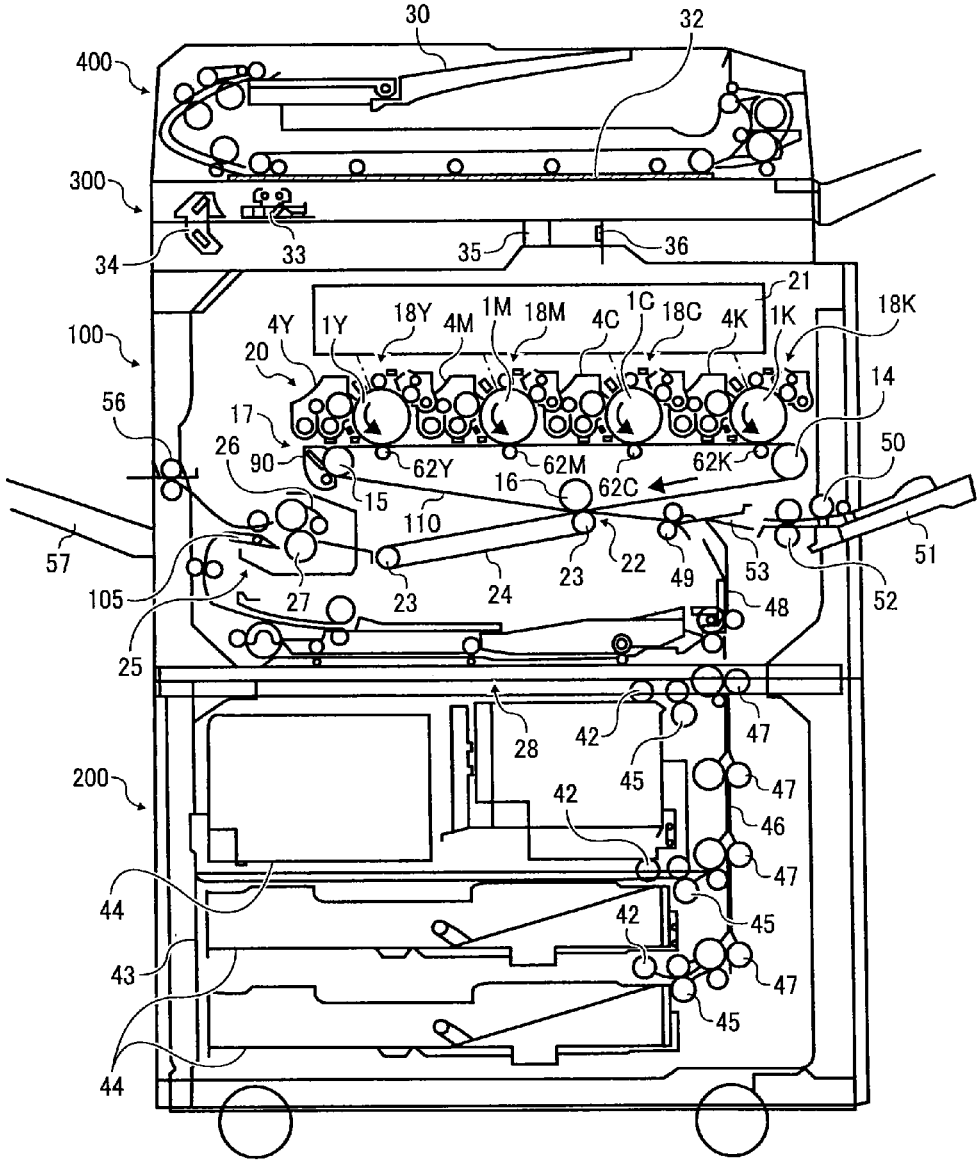
FIG. 1 is a view showing the schematic configuration of a copying machine according to an embodiment of the present invention.

First of all, the summary of the present invention will be described.

In the developing device of the present invention, when the developer bulk exceeds a predetermined height level in the vicinity of a downstream end in the conveyance direction of a supply conveyance path, developer discharge means serves to discharge some of the developer, and thus a stable amount of developer is obtained in the developing device when the developer exists in the vicinity of the downstream end in the conveyance direction of the supply conveyance path so as not to exceed the predetermined height level.

When the developer is supplied into the developing device by developer replenishing means and thereby the amount of developer within the developing device increases, the amount of developer that is conveyed from the supply conveyance path to reach the downstream end in the conveyance direction of the supply conveyance path becomes larger than the amount of developer that is delivered from the supply conveyance path to a circulation conveyance path. Consequently, the amount of developer accumulated in the vicinity of the downstream end in the conveyance direction of the supply conveyance path increases and, consequently, the developer bulk increases. Therefore, in the case in which the accumulated developer exceeds the predetermined height level, some of the accumulated developer is discharged by the developer discharge means so that the developer bulk is at the predetermined height level. Here, unlike the developer that constantly moves, the accumulated developer does not scatter easily, and thus the bulk of the accumulated developer changes appropriately as the amount of developer within the developing device increases or decreases. Therefore, a necessary amount of developer can be secured within the developing device.

Moreover, in the developing device of the present invention, when the amount of developer to be conveyed, which is regulated by developer conveyance amount regulating means, exceeds a predetermined amount, the developer discharge port discharges some of the developer. Therefore, a stable amount of developer is obtained in the developing device when the developer exists in the vicinity of the regulating position so as not to exceed the predetermined amount.

When the developer is supplied into the developing device by developer replenishing means and thereby the amount of developer within the developing device increases, the amount of developer reaching the regulating position becomes larger than the amount of developer passing through the regulating position, and thus the amount of developer accumulating in the regulating position increases. Therefore, when the amount of the accumulated developer exceeds the predetermined amount, some of the accumulated developer is discharged from the developer discharge port so that the amount of developer becomes the predetermined amount. Here, unlike the developer that constantly moves, the accumulated developer does not scatter easily, and thus the amount of the accumulated developer changes appropriately as the amount of developer within the developing device increases or decreases. Therefore, the necessary amount of developer can be secured within the developing device.

As an image forming apparatus to which the present invention is applied, an embodiment of a tandem color laser copying machine (simply called "copying machine" hereinafter) in which a plurality of photoreceptors are disposed in parallel with each other will be described below.

FIG. 1 shows the schematic configuration of the copying machine according to the present embodiment. This copying machine has a printer portion 100, a sheet feeding device 200 on which the printer portion 100 is placed, a scanner 300 placed fixedly on the printer portion 100, and the like. The copying machine also has an automatic original conveying device 400 that is placed fixedly on the scanner 300.

The printer portion 100 has an image forming unit 20 that is constituted by four process cartridges 18Y, M, C and K for forming images of colors of yellow (Y), magenta (M), cyan (C), and black (K) respectively. The letters Y, M, C and K provided at the ends of the reference numerals indicate the members for the colors, yellow, cyan, magenta and black, respectively (same hereinafter). An optical writing unit 21, an intermediate transfer unit 17, a secondary transfer device 22, a resist roller pair 49, a belt fixing type fixing device 25 and the like are disposed besides the process cartridges 18Y, M, C and K.

The optical writing unit 21 has a light source, a polygon mirror, an f–θ lens, a reflecting mirror and the like that are not shown, and emits a laser beam onto the surface of an after-described photoreceptor on the basis of image data.

Each of the process cartridges 18Y, M, C and K has a drum-like photoreceptor 1, a charging unit, a developing device 4, a drum cleaning device, a destaticizing unit, and the like.

The yellow process cartridge 18 will be described hereinafter.

The surface of a photoreceptor 1Y is uniformly charged by the charging unit functioning as charging means. The surface of the photoreceptor 1Y that is subjected to charging processing is irradiated with a laser beam that is modulated and deflected by the optical writing unit 21. Consequently, the potential of the irradiated portion (exposed portion) is attenuated. Due to this attenuation, a Y electrostatic latent image is formed on the surface of the photoreceptor 1Y. The formed Y electrostatic latent image is developed by a developing device 4Y serving as developing means, whereby a Y toner image is obtained.

The Y toner image formed on the Y photoreceptor 1Y is primarily transferred to an intermediate transfer belt 110 described hereinafter. Transfer residual toner on the surface of the photoreceptor 1Y is cleaned by the drum cleaning device after the Y toner image is primarily transferred.

In the Y process cartridge 18Y, the photoreceptor 1Y that is cleaned by the drum cleaning device is destaticized by the destaticizing unit. Then, the photoreceptor 1Y is uniformly charged by the charging unit and thereby returns to the initial state. The series of processes described above is the same for the other process cartridges 18M, C and K.

The intermediate transfer unit will be described next.

The intermediate transfer unit 17 has the intermediate transfer belt 110, a belt cleaning device 90 and the like. The intermediate transfer unit 17 further has a stretching roller 14, a drive roller 15, a secondary transfer backup roller 16, four primary transfer bias rollers 62Y, M, C and K, and the like.

The intermediate transfer belt 110 is tension-stretched by a plurality of rollers including the stretching roller 14. The intermediate transfer belt 110 is then moved endlessly in a clockwise direction in the drawing by rotation of the drive roller 15 that is driven by a belt drive motor, not shown.

Each of the four primary transfer bias rollers 62Y, M, C and K is disposed in contact with the inner peripheral surface of the intermediate transfer belt 110, and is applied with a primary transfer bias from a power source, not shown. Furthermore, the inner peripheral surface of the intermediate transfer belt 110 is pressed against the photoreceptors 1Y, M, C and K to form primary transfer nips. At each of the primary transfer nips, a primary transfer electric field is formed between each photoreceptor and each primary transfer bias roller due to the influence of the primary transfer bias.

The abovementioned Y toner image formed on the Y photoreceptor 1Y is primarily transferred onto the intermediate transfer belt 110 due to the influence of the primary transfer electric field or nip pressure. M, C and K toner images formed on the M, C and K photoreceptors 1M, C and K are sequentially superimposed and primarily transferred onto the Y toner image. A four-color superimposed toner image (called "four-color toner image" hereinafter), i.e., the multiple toner image, is formed on the intermediate transfer belt 110 due to the primary transfer performed by superimposing these toner images.

The four-color toner image that is transferred onto the intermediate transfer belt 110 is secondarily transferred onto a transfer sheet, i.e., a recording medium that is not shown, by a secondary transfer nip described hereinafter. The residual transfer toner that remains on the surface of the intermediate transfer belt 110 after the developer passes through the secondary transfer nip is cleaned by the belt cleaning device 90 that holds the belt between this belt cleaning device 90 and the drive roller 15 located on the left side of the drawing.

Next, the secondary transfer device 22 will be described.

The secondary transfer device 22 that stretches a sheet conveying belt 24 by means of two stretching rollers 23 is disposed on the lower side of the intermediate transfer unit 17 as shown. The sheet conveying belt 24 is endlessly moved in a counterclockwise direction in the drawing as at least either one of the stretching rollers 23 is driven and rotated. Of the two stretching rollers 23, the one roller disposed on the right side in the drawing holds the intermediate transfer belt 110 and the sheet conveying belt 24 between this stretching roller and the secondary backup roller 16 of the intermediate transfer unit 17. Accordingly, the secondary transfer nip where the intermediate transfer belt 110 of the intermediate transfer unit 17 comes into contact with the sheet conveying belt 24 of the secondary transfer device 22 is formed. Then, this stretching roller 23 is applied with a secondary transfer bias having a polarity opposite to the polarity of the toner, by the unshown power source. Due to this application of the secondary transfer bias, a secondary transfer electric field that electrostatically moves the four-color toner image formed on the intermediate transfer belt 110 of the intermediate transfer unit 17 from the belt side toward this stretching roller 23 is formed at the secondary transfer nip. The four-color toner image that is affected by the secondary transfer electric field or nip pressure is secondarily transferred onto the transfer sheet which is sent to the secondary transfer nip by the after-described resist roller pair 49 in synchronization with the four-color toner image formed on the intermediate transfer belt 110. It should be noted that a charger for charging the transfer sheet in a noncontact manner may be provided in place of the secondary transfer system that applies a secondary transfer bias to this stretching roller 23.

In the sheet feeding device 200 provided in a lower section of the copying machine main body, a plurality of sheet feeding cassettes 44, each of which can contain a plurality of stacked transfer sheets, are disposed vertically in a stacked manner. Each of the sheet feeding cassettes 44 presses the top transfer sheet of the stacked transfer sheets against a sheet feeding roller 42. Then, by rotating the sheet feeding roller 42, the top transfer sheet is sent out toward a sheet feeding path 46.

The sheet feeding path 46 that receives the transfer sheet sent out from the sheet feeding cassette 44 has a plurality of conveying roller pairs 47 and the resist roller pair 49 that is provided in the vicinity of an end of the sheet feeding path 46. The sheet feeding path 46 conveys the transfer sheet toward the resist roller pair 49. The transfer sheet conveyed toward the resist roller pair 49 is sandwiched between the roller portions of the resist roller pair 49. On the other hand, in the intermediate transfer unit 17, the four-color toner image formed on the intermediate transfer belt 110 enters the secondary transfer nip as the belt endlessly moves. The resist roller pair 49 sends the transfer sheet sandwiched between the roller portions at timing at which the transfer sheet is attached to the four-color toner image at the secondary transfer nip. In this manner, the four-color toner image formed on the intermediate transfer belt 110 is attached to the transfer sheet at the secondary transfer nip. Then, the four-color toner image is secondarily transferred onto the transfer sheet and thereby becomes a full-color image on the white transfer sheet. The transfer sheet on which the full-color image is formed in this manner leaves the secondary transfer nip as the sheet conveying belt 24 endlessly moves, and is then sent from the top of the sheet conveying belt 24 to the fixing device 25.

The fixing device 25 has a belt unit that is caused to move endlessly while stretching a fixing belt 26 by means of two rollers, and a pressure roller 27 that is pressed against one of the rollers of the belt unit. The fixing belt 26 and the pressure roller 27 abut against each other to form a fixing nip, and the transfer sheet received from the sheet conveying belt 24 is sandwiched by this nip. Of the two rollers of the belt unit, the roller that is pressed by the pressure roller 27 has a heat source therein, not shown, and applies pressure on the fixing belt 26 by using heat generated by the heat source. The fixing belt 26 applied with pressure heats the transfer sheet sandwiched by the fixing nip. Due to the application of heat or the nip pressure, the full-color image is fixed onto the transfer sheet.

The transfer sheet that is subjected to fixing processing in the fixing device 25 is either stacked on a stack portion 57 provided outside of a plate of a printer casing on the left side of the drawing, or is returned to the abovementioned secondary transfer nip in order to form a toner image on the other side of the transfer sheet.

When making a copy of an original, not shown, for example, a sheaf of sheet originals is set on an original platen 30 of the automatic original conveying device 400. However, if this original is a one-filing original closed by the subject document, the sheaf of sheet originals is set on a contact glass 32. Prior to this setting operation, the automatic original conveying device 400 is opened with respect to the copying machine main body, and thereby the contact glass 32 of the scanner 300 is exposed. Thereafter, the one-filing original is pressed by the closed automatic original conveying device 400.

After the original is set in this manner, an unshown copy start switch is pressed, whereby original reading operation is performed by the scanner 300. However, if a sheet original is set on the automatic original conveying device 400, the automatic original conveying device 400 automatically moves the sheet original to the contact glass 32 before the original reading operation is performed. When the original reading operation is performed, a first traveling body 33 and a second traveling body 34 start traveling together first, and light is emitted from a light source provided in the first traveling body 33. Then, the light reflected from the surface of the original is reflected by a mirror provided within the second traveling body 34, passes through an image forming lens 35, and thereafter enters a read sensor 36. The read sensor 36 constructs image information based on the reflected light.

In parallel with such original reading operation, each element within each of the process cartridges 18Y, M, C and K, the intermediate transfer unit 17, the secondary transfer device 22, and the fixing device 25 start driving. Then, the optical writing unit 21 is driven and controlled based on the image information constructed by the read sensor 36, and Y, M, C and K toner images are formed on the photoreceptors 1Y, M, C and K respectively. These toner images become a four-color toner image by superimposing and transferring these toner images on the intermediate transfer belt 110.

Moreover, at substantially the same time as when the original reading operation is performed, a sheet feeding operation is started in the sheet feeding device 200. In this sheet feeding operation, one of the sheet feeding rollers 42 is selected and rotated, and transfer sheets are sent out from one of the sheet feeding cassettes 44 that are stored in multiple stages in a sheet bank 43. The sent transfer sheets are separated one by one by a separating roller 45. Each sheet enters a reversal sheet feeding path 46 and is then conveyed to the secondary transfer nip by the conveying roller pairs 47. Sheets are sometimes fed from a manual tray 51 in place of the sheet feeding cassettes 44. In this case, after a manual sheet feeding roller 50 is selected and rotated to send out transfer sheets placed on the manual tray 51, the separation roller 52 separates the transfer sheets one by one and feeds each sheet to a manual sheet feeding path 53 of the printer portion 100.

In the present copying machine, when forming other color image composed of toners of two or more colors, the intermediate transfer belt 110 is stretched such that an upper stretching surface thereof lies substantially horizontally, and all of the photoreceptors 1Y, M, C and K are brought into contact with the upper stretching surface. On the other hand, when forming a monochrome image composed of the K toner only, the intermediate transfer belt 110 is tilted downward to the left in the drawing by using an unshown mechanism, and the upper stretching surface is separated from the Y, M and C photoreceptors 1Y, M and C. Then, out of the four photoreceptors 1Y, M, C and K, only the K photoreceptor 1K is rotated in the counterclockwise direction in the drawing to form a K toner image only. At this moment, for Y, M and C, driving of the photoreceptors 1 thereof and a developing unit is stopped to prevent the photoreceptors and developer from being depleted unnecessarily.

The present copying machine has a control unit, not shown, which is configured by a CPU and the like that control the following elements within the copying machine, and an operation display portion, not shown, which is configured by a liquid crystal display, various keybuttons, and the like. An operator can select one of three one-side printing modes for forming an image on one side of a transfer sheet, by sending a command to the control unit based on the implementation of a key input operation in the operation display portion. The three one-side printing modes are a direct discharge mode, a reversal discharge mode, and a reversal decal discharge mode.

Figure 2:
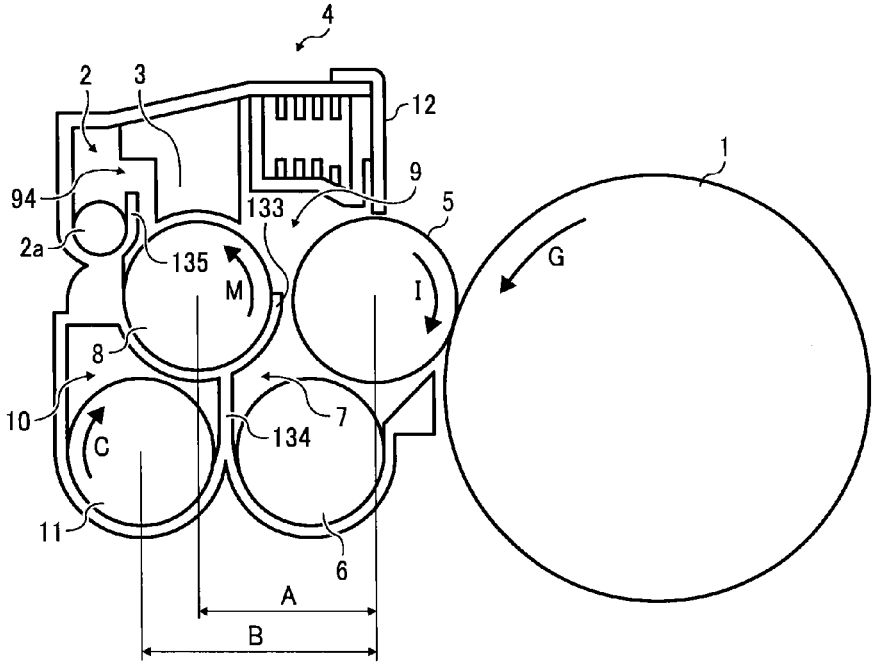
FIG. 2 is a view showing the schematic configurations of a developing device and a photoreceptor of the copying machine.

FIG. 2 shows the developing device 4 provided in one of the four process cartridges 18Y, M, C and K and the photoreceptor 1. Apart from the fact that they handle different colors, the configurations of the four process cartridges 18Y, M, C and K are essentially identical and, accordingly, the letters Y, M, C and K applied to the "4" of the drawing have been omitted.

The surface of the photoreceptor 1 is charged by the charging device, not shown, as it rotates in the direction of the arrow G in the drawing shown in FIG. 2. Toner is supplied from the developing device 4 to a latent image formed as an electrostatic latent image on the surface of the charged photoreceptor 1 by a laser beam irradiated from an exposure device, not shown, to form a toner image.

The developing device 4 has a developing roller 5 that serves as a developer carrier for supplying the toner to develop the latent image on the surface of the photoreceptor 1 while surface-moving in the direction of the arrow I of the drawing. The developing device 4 also has a supply screw 8 serving as a supply conveying member for, while supplying the developer to the developing roller 5, conveying the developer in the direction toward the far side of FIG. 2.

A development doctor 12 serving as a developer regulating member for regulating the thickness of the developer supplied to the developing roller 5 to a thickness suitable for development is provided on the downstream side in the direction of surface movement of the developing roller 5 from a part thereof facing the supply screw 8.

A recovery screw 6 serving as a recovery conveying member for recovering the developer that has passed through the developing portion and used for development and for conveying the recovered recovery developer in the same direction as the direction of the supply screw 8 is provided on the downstream side in the direction of surface movement of the developing roller 5 from the developing portion which constitutes a part facing the photoreceptor 1. A supply conveyance path 9 having the supply screw 8 is disposed in the lateral direction of the developing roller 5, and a recovery conveyance path 7 serving as a recovery conveyance path having the recovery screw 6 is disposed in parallel below the developing roller 5.

A stirring conveyance path 10 is provided in the developing device 4 in parallel with the recovery conveyance path 7 below the supply conveyance path 9. The stirring conveyance path 10 has a stirring screw 11 serving as a stirring/conveying member for, while stirring the developer, conveying it in the opposite direction to the direction of the supply screw 8, the opposite direction being oriented on the near side in the drawing.

The supply conveyance path 9 and the stirring conveyance path 10 are partitioned by a first partition wall 133 serving as a partition member. An opening portion is formed in a part of the first partition wall 133 that partitions the supply conveyance path 9 and the stirring conveyance path 10, at both ends in the near side and far side of the drawing to connect the supply conveyance path 9 and the stirring conveyance path 10 to each other.

Note that the supply conveyance path 9 and the recovery conveyance path 7 are also partitioned by the first partition wall 133, but there is no opening portion provided in the part of the first partition wall 133 that partitions the supply conveyance path 9 and the recovery conveyance path 7.

The two conveyance paths of the stirring conveyance path 10 and the recovery conveyance path 7 are also partitioned by a second partition wall 134 serving as a partition member. An opening portion is formed in the second partition wall 134 at the near side in the drawing to connect the stirring conveyance path 10 and the recovery conveyance path 7 to each other.

The supply screw 8 serving as the supply conveying member of developer conveying members, the recovery screw 6, and the stirring screw 11 are made of resin or metal. The diameter of each screw is set to $\phi$22 [mm]. The supply screw has a screw pitch of 50 [mm] in the form of a double winding, and the recovery screw 6 and the stirring screw 11 each have a screw pitch of 25 [mm] in the form of a single winding. The revolution speed of each screw is set to approximately 600 [rpm].

The developer that is thinned by the stainless developing doctor 12 on the developing roller 5 is conveyed to a developing region facing the photoreceptor 1, to perform development. The surface of the developing roller 5 made of an Al or SUS pipe stock with a diameter of $\phi$25 [mm] has a V-shaped groove or is sandblasted. The size of the gap formed between the developing doctor 12 and the photoreceptor 1 is approximately 0.3 [mm].

The developer obtained after development is recovered in the recovery conveyance path 7, then conveyed to the near side of the cross section of FIG. 2, and then transferred to the stirring conveyance path 10 at the opening portion of the first partition wall 133 provided in a non-image region. It should be noted that toner is replenished from a toner replenishing port provided above the stirring conveyance path 10 to the stirring conveyance path 10, in the vicinity of the opening portion of the first partition wall 133 on the upstream side in the developer conveyance direction in the stirring conveyance path 10.

Next, the circulation of the developer within the three developer conveyance paths will be described.

Figure 3:
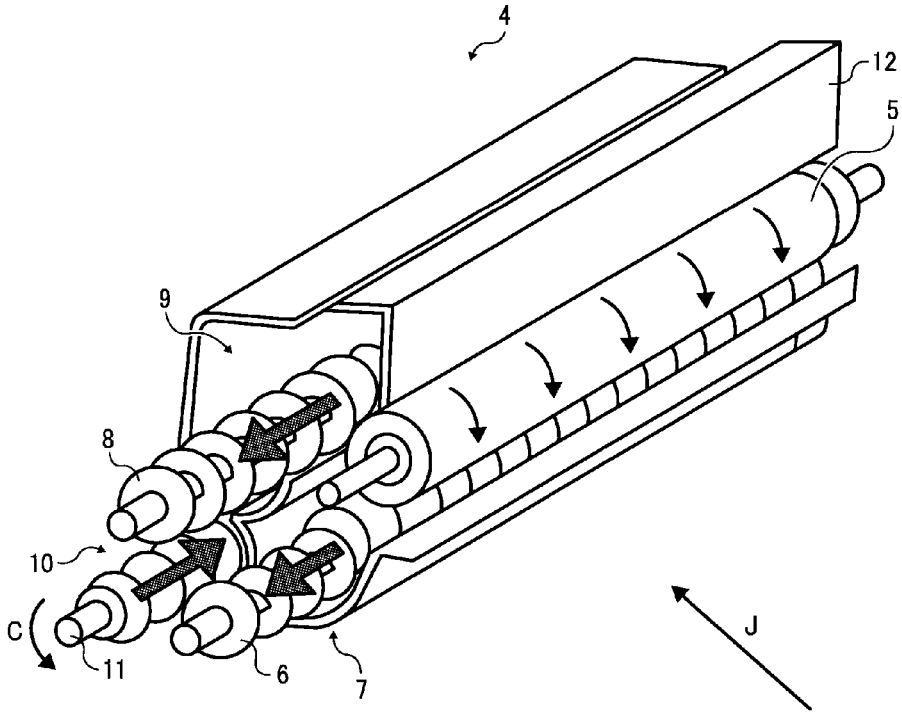
FIG. 3 is an external perspective sectional view showing a part of the developing device to explain a flow of a developer.

FIG. 3 shows a flow of the developer within the developer conveyance paths. The arrows in the drawing indicate the directions of movement of the developer.

Figure 4:
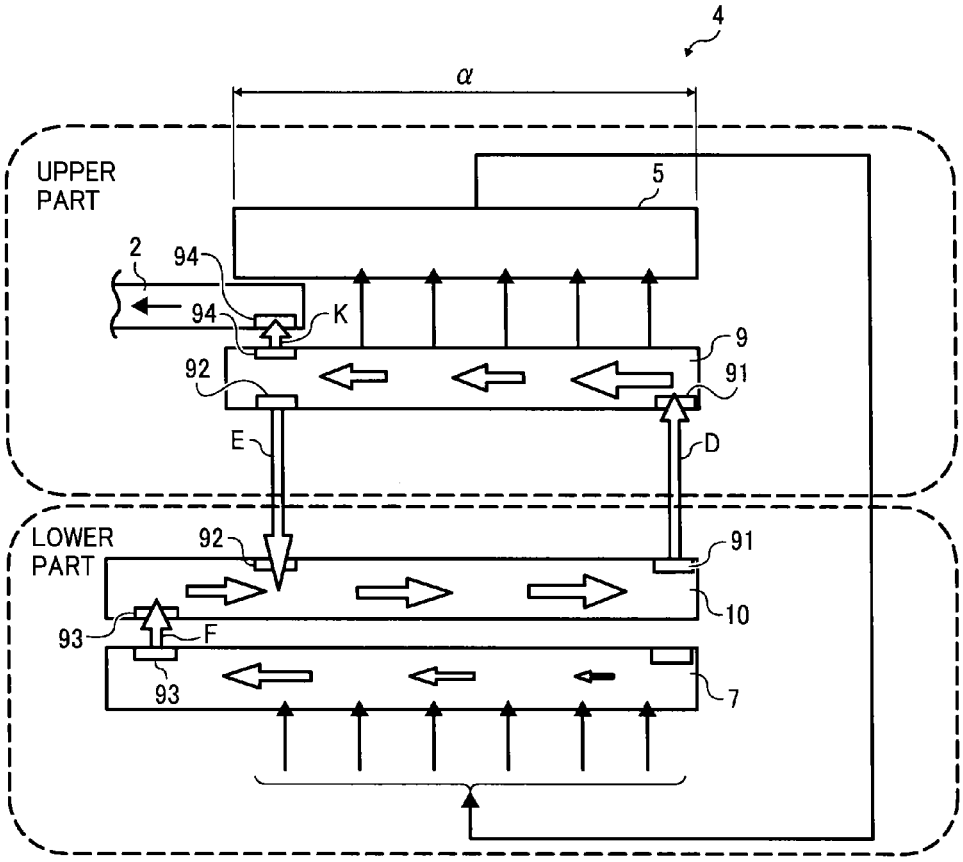
FIG. 4 is a schematic diagram showing the flow of the developer within the developing device.

Also, FIG. 4 shows a flow of the developer within the developing device 4. As with FIG. 3, the arrows in the drawing indicate the directions of movement of the developer.

In the supply conveyance path 9 to which the developer is supplied from the stirring conveyance path 10, the developer is conveyed to the downstream side in the direction of conveyance of the supply screw 8, while being supplied to the developing roller 5. Excess developer that is supplied to the developing roller 5 and conveyed to a downstream end in the conveyance direction of the supply conveyance path 9 without being used in development is supplied to the stirring conveyance path 10 through an excess opening portion 92 of the first partition wall 133 (arrow E in FIG. 4).

The recovery developer that is fed from the developing roller 5 to the recovery conveyance path 7 and conveyed to the downstream end in the conveyance direction of the recovery conveyance path 7 by the recovery screw 6 is supplied to the stirring conveyance path 10 through a recovery opening portion 93 of the second partition member 134 (arrow F in FIG. 4).

The stirring conveyance path 10 stirs the supplied excess developer and recovery developer, conveys thus obtained mixture to the upstream side in the conveyance direction of the supply screw 8, which constitutes the downstream side in the conveyance direction of the stirring screw 11, and supplies it to the supply conveyance path 9 through a supply opening portion 91 of the first partition wall 133 (arrow D in FIG. 4).

In the stirring conveyance path 10, the recovery developer, excess developer, and toner replenished from a transporting portion according to need are stirred and conveyed in the direction opposite to that of the developer of the recovery path 7 and the supply path 9, by means of the stirring screw 11. The stirred developer is transported to the upstream side in the conveyance direction of the supply conveyance path 9 that is communicated at the downstream side in the conveyance direction. Note that a toner density sensor, not shown, is provided below the stirring conveyance path 10, and a toner replenishment control device, not shown, is actuated by the output of the sensor so that the toner is replenished from a toner containing portion, not shown.

In the developing device 4 shown in FIG. 4 having the supply conveyance path 9 and the recovery conveyance path 7, because the developer is supplied and recovered in the different developer conveyance paths, the developer used for development is prevented from being mixed in the supply conveyance path 9. Accordingly, the toner density of the developer supplied to the developing roller 5 is prevented from decreasing as the developer is sent toward the downstream side in the conveyance direction of the supply conveyance path 9. In addition, because the developing device has the recovery conveyance path 7 and the stirring conveyance path 10 and the developer is recovered and stirred in the different developer conveyance paths, loss of the developer used in development while it is being stirred is prevented. Accordingly, because the insufficiently stirred developer is supplied to the supply conveyance path 9, insufficient stirring of the developer to be supplied to the supply conveyance path 9 can be prevented. Because the toner density of the developer of the supply conveyance path 9 is prevented from decreasing and insufficient stirring of the developer in the supply conveyance path 9 is prevented in this manner, a constant image density can be ensured throughout development.

As shown in FIG. 4, the developer is moved from the lower part of the developing device 4 to the upper part of the same in the direction of the arrow D only. The developer is moved in the direction of the arrow D to raise the developer and supply the developer to the supply conveyance path 9 by pushing the developer using the rotation of the stirring screw 11.

Such movement of the developer causes stress on the developer, reducing the life of the developer.

When the developer is lifted up as described above, stress is placed on the developer, whereby scraping of a carrier film and toner spending occur at the stressed part of the developer, and consequently stable image quality can no longer be maintained.

Therefore, the life of the developer can be extended by alleviating the stress that is placed on the developer when the developer is moved in the direction of the arrow D. By extending the life of the developer, it becomes possible to provide a developing device capable of preventing the developer from being degraded and capable of providing stable image quality with no image density irregularity.

In the developing device 4 of the present embodiment, the supply conveyance path 9 is disposed obliquely upward above the stirring conveyance path 10, as shown in FIG. 2. By disposing the supply conveyance path 9 obliquely upward, the stress placed on the developer when moving the developer in the direction of the arrow D can be alleviated more, as compared with the case in which the supply conveyance path 9 is provided directly above the stirring conveyance path 10 to lift up the developer.

Furthermore, in the developing device 4, the supply conveyance path 9 and the stirring conveyance path 10 are disposed obliquely, whereby an upper wall surface of the stirring conveyance path 10 is disposed higher than a lower wall surface of the supply conveyance path 9 as shown in FIG. 2.

When the supply conveyance path 9 is lifted up vertically from the stirring conveyance path 10, the developer is lifted up by the pressure of the stirring screw 11 against gravitational force, and thus stress is placed on the developer. However, by disposing the upper wall surface of the stirring conveyance path 10 to be higher than the lower wall surface of the supply conveyance path 9, the developer existing at the uppermost point of the stirring conveyance path 10 can flow into the lowermost point of the supply conveyance path 9 without fighting gravity, and thus the stress placed on the developer can be reduced.

It should be noted that a fin member may be provided on the axis of the stirring screw 11, which is a section where the stirring conveyance path 10 and the supply conveyance path 9 are communicated with each other on the downstream side of the developer conveyance path of the stirring conveyance path 10. This fin member is a plate-like member configured by a side parallel to the axial direction of the stirring screw 11 and a side perpendicular to the axial direction of the stirring screw. By scooping up the developer using the fin member, the developer can be delivered efficiently from the stirring conveyance path 10 to the supply conveyance path 9.

Moreover, in the developing device 4 the supply conveyance path 9 and the stirring conveyance path 10 are disposed such that the center distance A between the developing roller 5 and the supply conveyance path 9 is shorter than the center distance B between the developing roller 5 and the stirring conveyance path 10. In this manner, the developer can be supplied from the supply conveyance path 9 to the developing roller 5 naturally, and the size of the apparatus can be reduced.

In addition, the stirring screw 11 rotates in the counterclockwise direction as viewed from the near side of FIG. 2 (direction of the arrow C in the drawing), so that the developer is lifted up along the shape of the stirring screw 11 and transported to the supply conveyance path 9. Accordingly, the developer can be lifted up efficiently, and also the stress placed thereon can be reduced.

Figure 5:
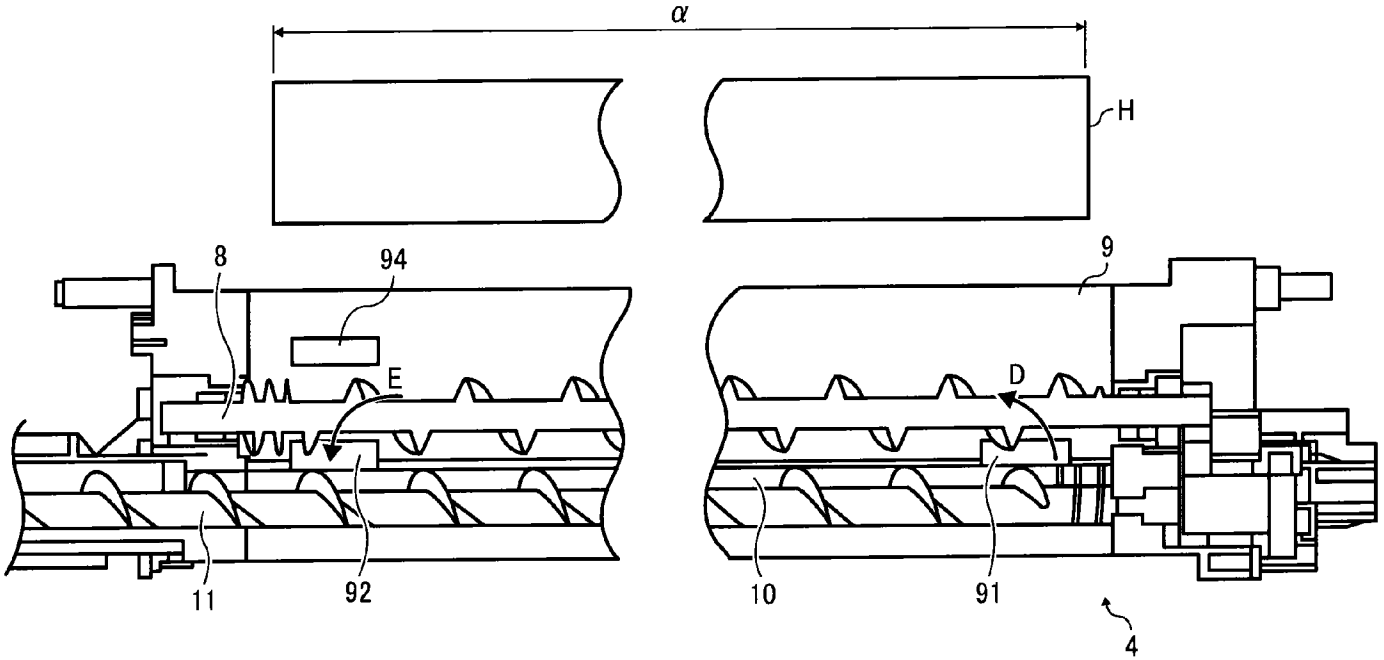
FIG. 5 is a cross-sectional view showing the configuration of the developing device.

FIG. 5 is a cross-sectional view of the rotation center of the supply screw 8 of the developing device 4, the rotation center being viewed in the direction of the arrow J shown in FIG. 3. The letter H in the drawing shows a developing region in which the developing roller 5 serving as the developer carrier supplies the toner to the photoreceptor 1 serving as the latent image carrier. The width of the developing region H in the direction of rotation axis of the developing roller 5 is shown as developing region width $\alpha$.

As shown in FIG. 5, the developing device 4 is provided with, within the developing region width α, the supply opening portion 91 for lifting up the developer from the stirring conveyance path 10 to the supply conveyance path 9, and the excess opening portion 92 for dropping the developer from the supply conveyance path 9 to the stirring conveyance path 10.

Figure 6:
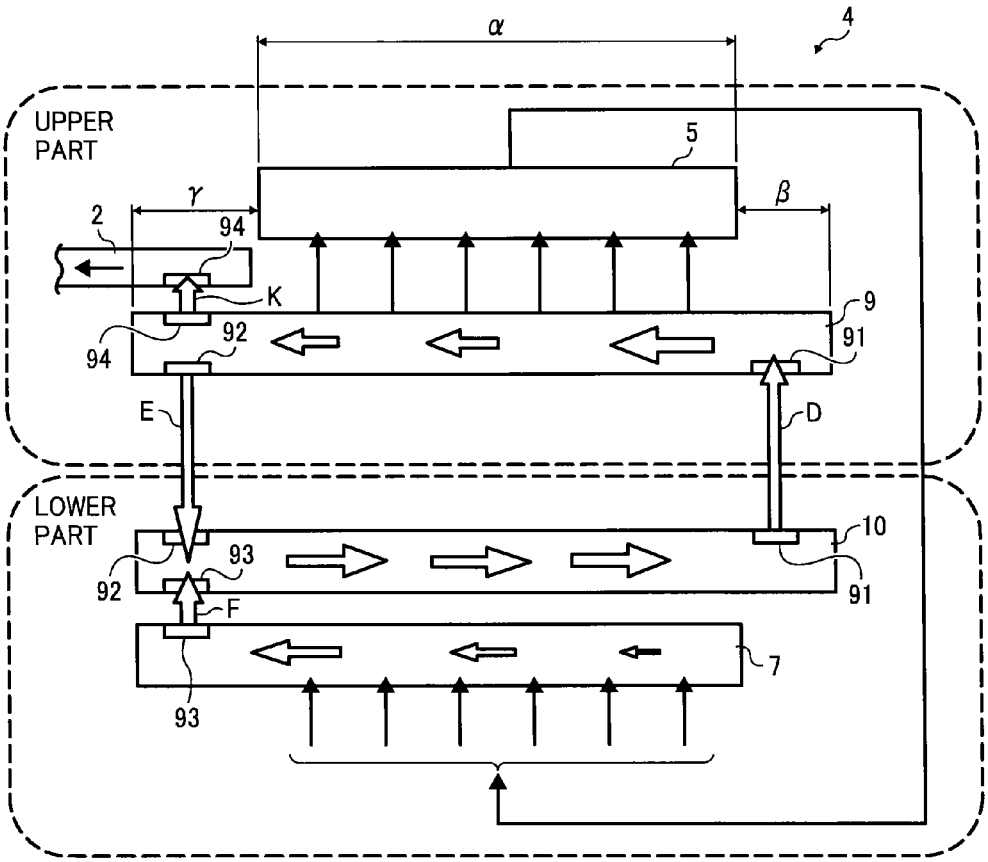
FIG. 6 is a schematic diagram showing a flow of the developer within a developing device having a shape different from that shown in FIG. 4.

FIG. 6 shows a flow of the developer within the developing device 4 having a different configuration from the developing device shown in FIG. 4.

In the developing device 4 shown in FIG. 6, the supply opening portion 91 and the excess opening portion 92 are provided outside the developing region width α. Because the supply opening portion 91 is provided outside the developing region width α, the upstream side in the conveyance direction of the supply conveyance path 9 is longer than the developing roller 5 by a supply conveyance path upstream region β. Also, because the excess opening portion 92 is provided outside the developing region width α, the downstream side in the conveyance direction of the supply conveyance path 9 is longer than the developing roller 5 by a supply conveyance path downstream region γ.

On the other hand, in the developing device 4 with the configuration shown in FIG. 4, because the supply opening portion 91 is provided within the developing region width α, the upstream side in the conveyance direction of the supply conveyance path 9 can be made shorter than the developing device 4 shown in FIG. 6 by the supply conveyance path upstream region β. Moreover, because the excess opening portion 92 is provided within the developing region width α, the downstream side in the conveyance direction of the supply conveyance path 9 can be made shorter than the developing device 4 shown in FIG. 6 by the supply conveyance path downstream region γ.

Because the supply opening portion 91 and the excess opening portion 92 of the developing device 4 shown in FIG. 4 are provided within the developing region width α as described above, the space in the upper part of the developing device 4 can be saved more, as compared with the developing device 4 shown in FIG. 6.

Figure 7:
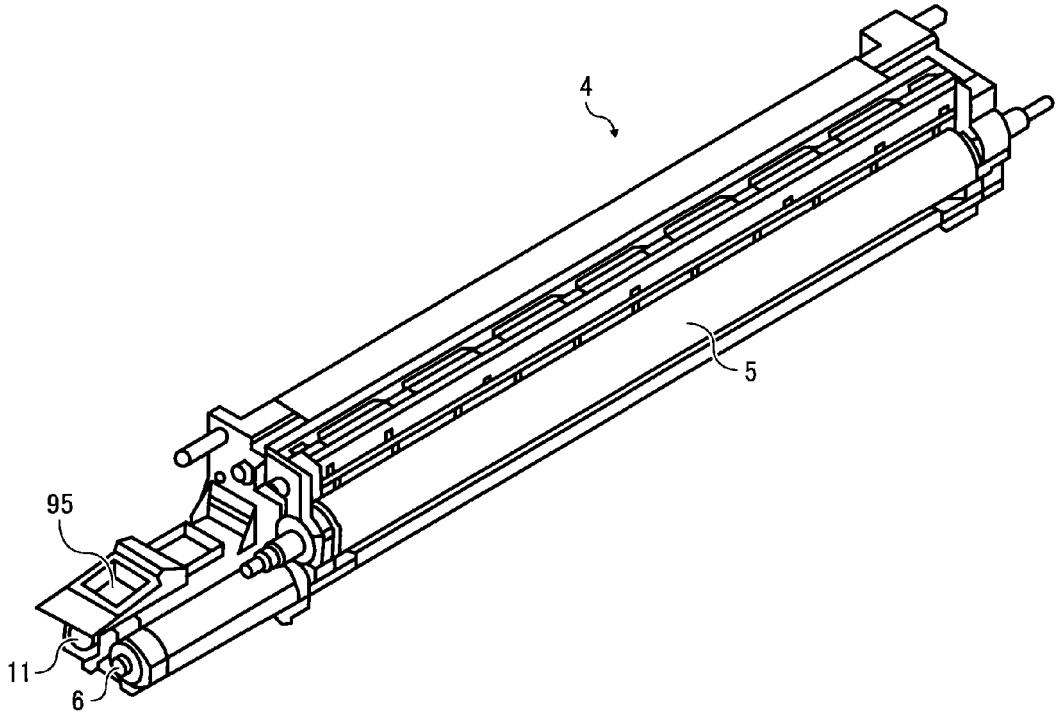
FIG. 7 is an external perspective view showing the configuration of the developing device.

Next is described the position where the toner is replenished to the developer conveyance paths constituted by the supply conveyance path 9, the stirring conveyance path 10 and the recovery conveyance path 7 of the developing device 4. FIG. 7 shows the exterior of the developing device 4.

As shown in FIG. 7, a toner replenishing port 95 for replenishing the toner is provided above an upstream end portion in the conveyance direction of the stirring conveyance path 10 having the stirring screw 11. Because this toner replenishing port 95 is provided outside the end portion in the width direction of the developing roller 5, it is positioned outside the developing region width α.

The section provided with the toner replenishing port 95 is an extension of the conveyance direction of the supply conveyance path 9, and corresponds to an empty space of the supply conveyance path downstream region γ shown in FIG. 6. By providing the toner replenishing port 95 in the empty space obtained by providing the excess opening portion 92 within the developing region width α, the size of the developing device 4 can be reduced.

The toner replenishing port 95 may be provided not only above the upstream end portion in the conveyance direction of the stirring conveyance path 10, but also above a downstream end portion of the recovery conveyance path 7.

Moreover, the toner replenishing port 95 may be provided immediately above the recovery opening portion 93, which is a section where the developer is delivered from the recovery conveyance path 7 to the stirring conveyance path 10. The space immediately above the recovery opening portion 93 is also the empty space obtained by providing the excess opening portion 92 within the developing region width α, and thus the size of the developing device 4 can be reduced by providing the toner replenishing port 95 at this position. Moreover, in the recovery opening portion 93 serving as the delivery portion, the developer is easily mixed, and thus the developer can be stirred more efficiently by performing replenishment at this position.

As in the developing device 4 described with reference to FIG. 4, there are provided within the developing region width α the supply opening portion 91 for delivering the developer from the downstream end in the conveyance direction of the stirring conveyance path 10 to the upstream end in the conveyance direction of the supply conveyance path 9, and the excess opening portion 92 for delivering the developer from the downstream end of the supply conveyance path 9 to the upstream end in the conveyance direction of the stirring conveyance path 10. Therefore, as compared with the conventional developing device 4, the space in the upper part of the developing device 4 can be saved, and the spaces in the entire developing device 4 can be also saved.

Moreover, the toner replenishing port 95 is provided in the empty space that is obtained by providing the excess opening portion 92 within the developing region width α, and thus the size of the developing device 4 can be reduced.

Because the toner is replenished from the upper part of the recovery opening portion 93 serving as the delivery portion for delivering the developer from the recovery conveyance path 7 to the stirring conveyance path 10, the developer can be stirred efficiently.

In addition, the developing device 4 is provided as the developing means of the printer portion 100 of the copying machine, i.e. the image forming apparatus, and thus the spaces of the entire apparatus can be saved.

Next, the characteristics of the developing device 4 of the present embodiment will be described.

The toner replenishment control device, not shown, which serves as the developer replenishing means, replenishes the toner stored in the toner container, not shown, from the toner replenishing port 95 to the developing device 4. In the developing device 4 of the present embodiment, the developer having toner and carrier is replenished from the toner replenishing port 95 of the developing device 4. Hereinafter, the developer with a mixture of toner and carrier, which is replenished to the developing device 4, is referred to as "premixed toner."

Also, the supply conveyance path 9 has a discharge conveyance path 2 and a developer discharge port 94 that are the developer discharge means for discharging some of the developer contained in the supply conveyance path 9 to the outside of the developing device 4 when the developer bulk exceeds a predetermined bulk. The discharge conveyance path 2 is disposed on the downstream side in the conveyance direction of the supply conveyance path 9 such as to be adjacent to the supply conveyance path 9 with a partition wall 135 therebetween. The developer discharge port 94 is an opening provided on the partition wall 135 such that the supply conveyance path 9 and the discharge conveyance path 2 are communicated with each other.

Also, as shown in FIG. 4, in the developing device 4 of the present embodiment the developer discharge port 94 is disposed in the vicinity of the downstream end in the conveyance direction of the supply conveyance path 9 so that, when the bulk of the developer exceeds the predetermined height level in the vicinity of the downstream end in the conveyance direction of the supply conveyance path 9, some of this developer is discharged.

Note that the vicinity of the downstream end in the conveyance direction of the supply conveyance path 9 is the same as the position of, for example, the developer delivery portion for delivering the developer from the supply conveyance path 9 to the stirring conveyance path 10 in terms of the conveyance direction of the supply conveyance path 9. In other words, the vicinity of the downstream end in the conveyance direction of the supply conveyance path 9 is located in a place where the conveying force obtained from the supply screw 8 is terminated, and is located immediately before a place applied with the conveying force of a reversal screw described hereinafter. By providing the developer discharge port 94 in this place, the developer is received by the conveying force of the reversal screw after being conveyed by the supply screw 8, and then the accumulated developer can be eventually discharged from the developer discharge port 94. Furthermore, although the developing device 4 is provided with the reversal screw, the conveying force is terminated so that the developer conveyed by the supply screw 8 accumulates at the developer discharge port 94, hence an end surface on the lowermost stream side of the supply conveyance path 9 may be in the form of a wall.

Figure 8:
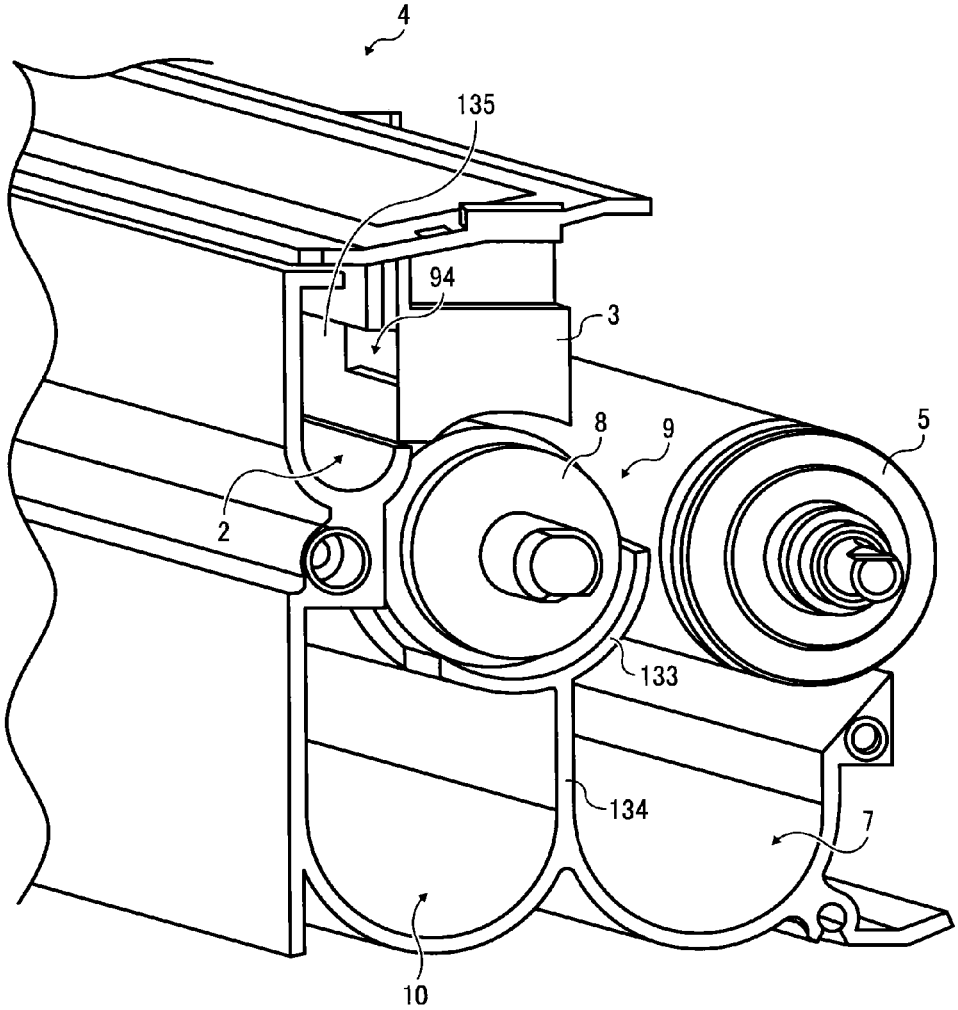
FIG. 8 is a perspective view showing the configuration of the vicinity of a near-side end portion of the developing device, which is obtained after removing a stirring screw, a recovery screw, and a developing doctor from the developing device.
Figure 9:
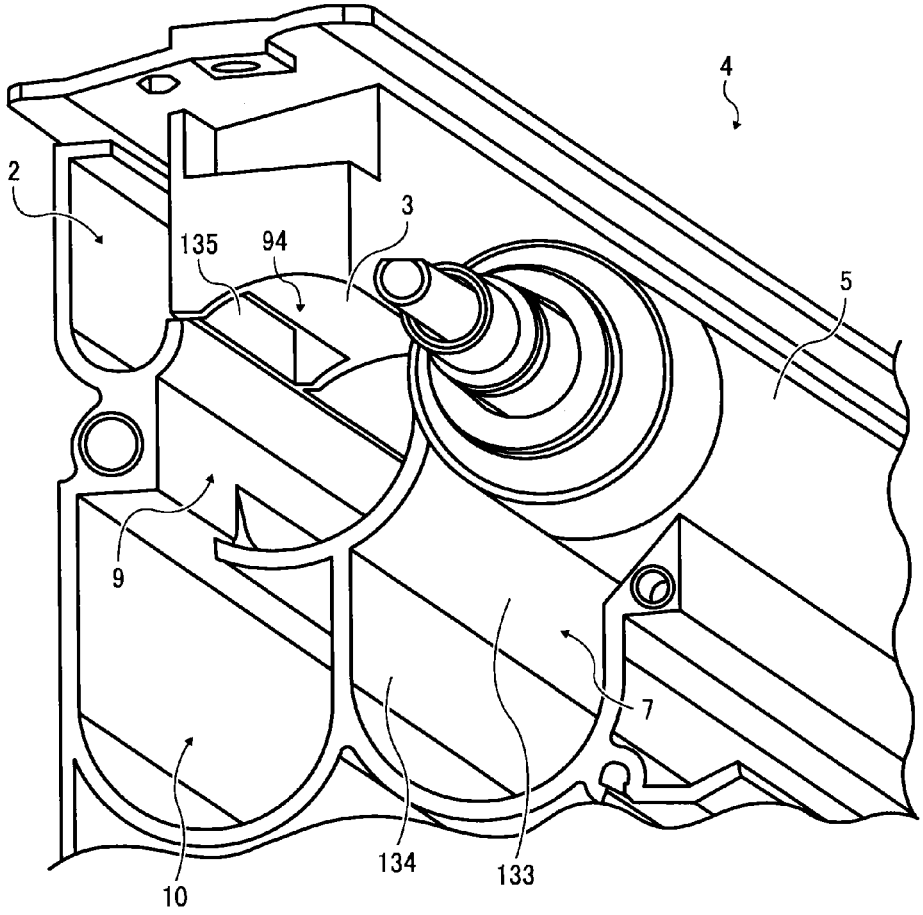
FIG. 9 is a perspective view showing the configuration of the vicinity of the near side of the developing device shown in FIG. 8, which is obtained after removing the supply screw therefrom.
Figure 10:
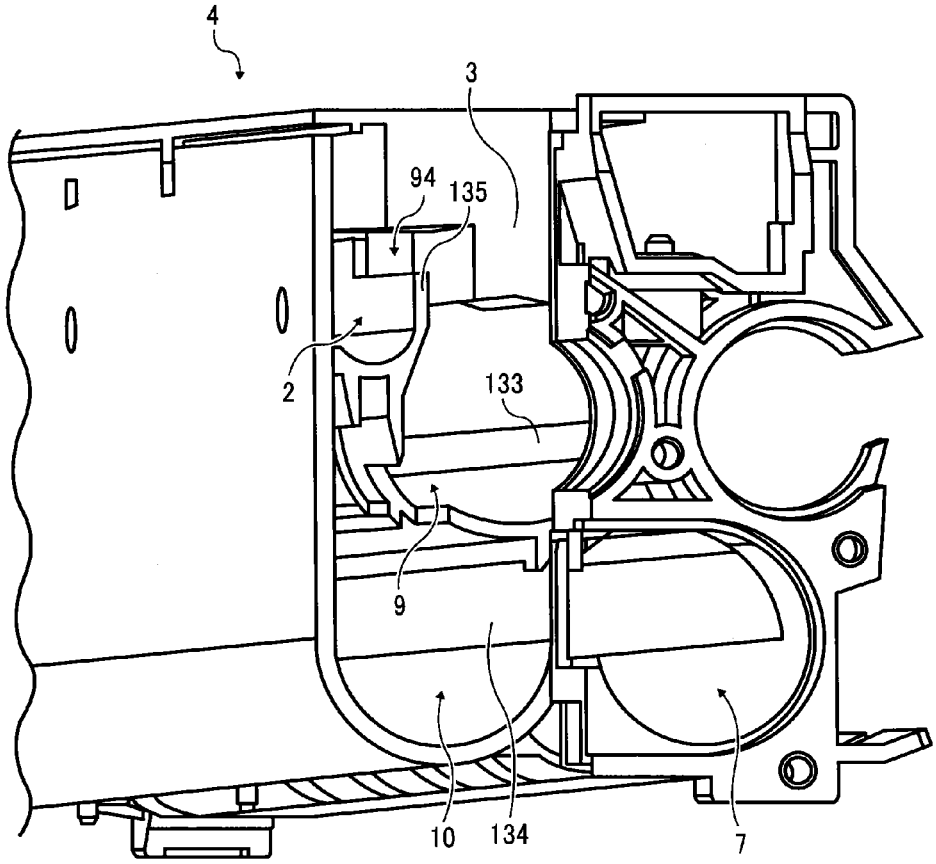
FIG. 10 is a perspective views showing the configuration of the vicinity of the near side of the developing device shown in FIG. 9, which is obtained after removing a developing roller therefrom.
Figure 11:
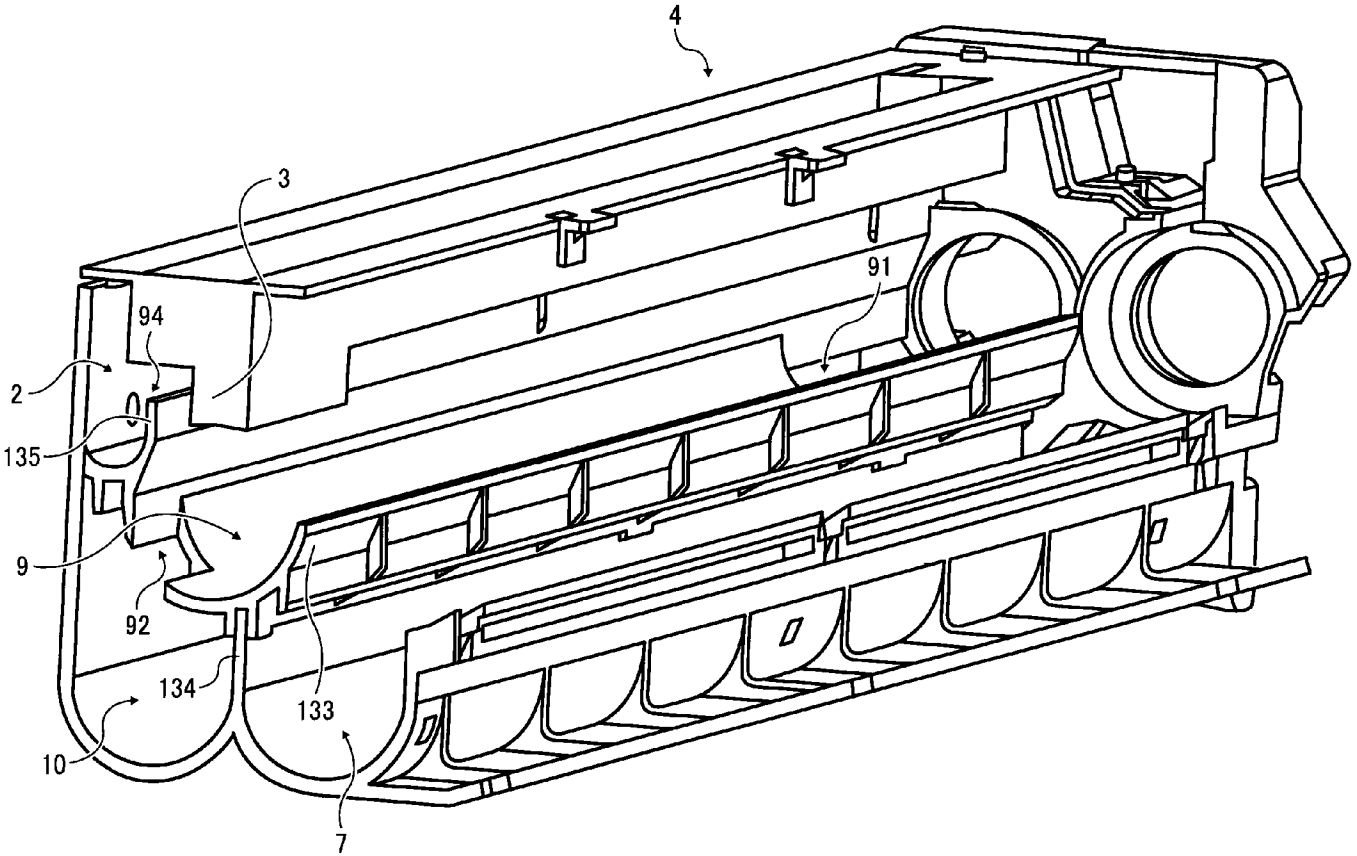
FIG. 11 is a perspective view, in which the developing device shown in FIG. 10 is viewed from a direction different from that of FIG. 10.

FIG. 8 shows the configuration of the vicinity of a near-side end portion of the developing device 4 in which the stirring screw 11, recovery screw 6 and developing doctor 12 are removed therefrom. FIG. 9 is a view showing the vicinity of the near side of the developing device 4 in which the supply screw 8 is further removed from the configuration shown in FIG. 8, the developing device being viewed from a direction different from that of FIG. 9. FIG. 10 shows the configuration obtained after removing the developing roller 5 from the developing device 4 shown in FIG. 9. FIG. 11 is a view in which the developing device 4 shown in FIG. 10 is viewed from substantially the same direction as that of FIG. 3

The direction of rotation of the supply screw 8 is a clockwise direction in FIG. 2 (direction of the arrow M), which is a direction in which the developer is lifted up from the lower side and then supplied to the developing roller 5. Here, if the direction of rotation of the supply screw 8 is changed to a counterclockwise direction and the developer is sprinkled onto the developing roller 5, the developer is supplied in a scattered manner to the developing roller 5. However, if the direction of rotation of the supply screw 8 is the clockwise direction as shown in FIG. 2, the developer that is accumulated in the lower part of the supply conveyance path 9 is lifted up from the lower side and supplied to the developing roller 5. The supplying properties of the developer can be stabilized by lifting up the developer from the lower part, instead of supplying the developer in a scattered manner. For this reason, the direction of rotation of the supply screw 8 of the developing device 4 is set to the clockwise direction as shown in FIG. 2.

Particularly when the developer supplied to the developing roller 5 is recovered to the recovery conveyance path 7 without being returned to the supply conveyance path 9 as in the developing device 4 of the present embodiment, the amount of developer decreases as it is sent to the downstream of supply conveyance path 9. Therefore, the developing device in which the developer accumulated in the lower part is scooped up and supplied to the developing roller 5 is excellent in terms of the developer supplying properties.

Here, in the supply conveyance path 9, the developer conveyed within the developer conveyance path 9 is scattered by its moving force in the supply conveyance path 9 or by the rotating force of the supply screw 8 serving as the developer conveying screw. Also, if the developer discharge port 94 is disposed simply at a predetermined height level of the supply conveyance path 9 serving as the developer conveyance path, the scattered developer might fly and be discharged through the developer discharge port 94. When the developer scatters and is discharged, there is a possibility that the scattered developer is discharged even if an appropriate amount or less of developer is conveyed from the position within the supply conveyance path 9 provided with the developer discharge port 94. If the scattered developer is discharged in this manner, there is a possibility that the developer within the developing device 4 is discharged from the developer discharge port despite that the amount of this developer is less than or equal to an appropriate amount. Consequently, the amount of developer within the developing device 4 falls below a necessary amount, whereby the developer cannot be supplied to the photoreceptor 1 stably. Then, if the developer is supplied to the photoreceptor 1 in an unstable manner, image omission and other abnormal images occur.

In order to avoid such problems, the developing device 4 has a block member 3 that serves as a scattered developer discharge prevention member for blocking a path through which scattered developer moves toward the developer discharge port 94, the scattered developer being obtained by rotating the supply screw 8, which is the supply conveying member included in the developer conveying members, to convey the developer. Because the developing device 4 has the block member 3 for blocking the path through which the scattered developer moves toward the developer discharge port 94, the scattered developer being obtained as a result of a conveyance operation performed by the supply screw 8, the scattered developer can be prevented from being discharged, and, despite that the amount of developer within the developing device 4 is not increased, the developer can be prevented from being discharged. For this reason, a necessary amount of developer can be secured within the developing device 4, and the developer can be supplied to the photoreceptor 1 stably. Accordingly, the electrostatic latent image on the photoreceptor 1 can be formed into a toner image well, the occurrence of image omission and other abnormal images can be prevented, and excellent image formation can be performed.

The block member 3 is a member the bottom surface of which is made of a hemispheric shaped resin that follows the shape of the supply screw 8 in the upper part of the supply conveyance path 9. Because the block member 3 is in a hemispheric shape so as to follow the shape of the supply screw 8, the bottom surface of the block member 3 can be entirely brought close to the supply screw 8 so as to cover the entire supply screw 8. Therefore, the upper part of the supply screw 8 that causes the developer to splash is covered, whereby the developer splashed by the supply screw 8 can be prevented from flying to the developer discharge port 94.

Furthermore, as shown in FIG. 11, because the block member 3 protrudes at the periphery of the developer discharge port 94 of the supply conveyance path 9, the section of the supply conveyance path provided with the block member 3 is made narrower than the supply conveyance path 9 on the upstream side in the conveyance direction of the supply screw 8 with respect to the block member 3. Therefore, the amount of developer in relation to the capacity of the supply conveyance path 9 is larger at the position provided with the block member 3 than the upstream side in the conveyance direction with respect to the position provided with the block member 3. Therefore, in the vicinity of the lower end portion in the conveyance direction of the supply conveyance path 9 where the developer is no longer applied with a conveying force, the developer rises between the side wall of the block member 3 and the partition wall 135. Consequently, the supply screw 8 is immersed in the developer, and the developer is prevented from being splashed by the rotation of the supply screw 8. Moreover, in the vicinity of the developer discharge port 94, the change in the developer surface that is caused when the supply screw flips when the upper part of the wing portion of the supply screw 8 is exposed from the developer surface can be alleviated. Therefore, sensitive discharge can be expected with respect to the increase and decrease in the amount of developer within the developing device 4.

By providing such block member 3, when the bulk of the developer is increased by supplying the developer, the increment of the developer overflows from the developer discharge port 94.

Figure 12:
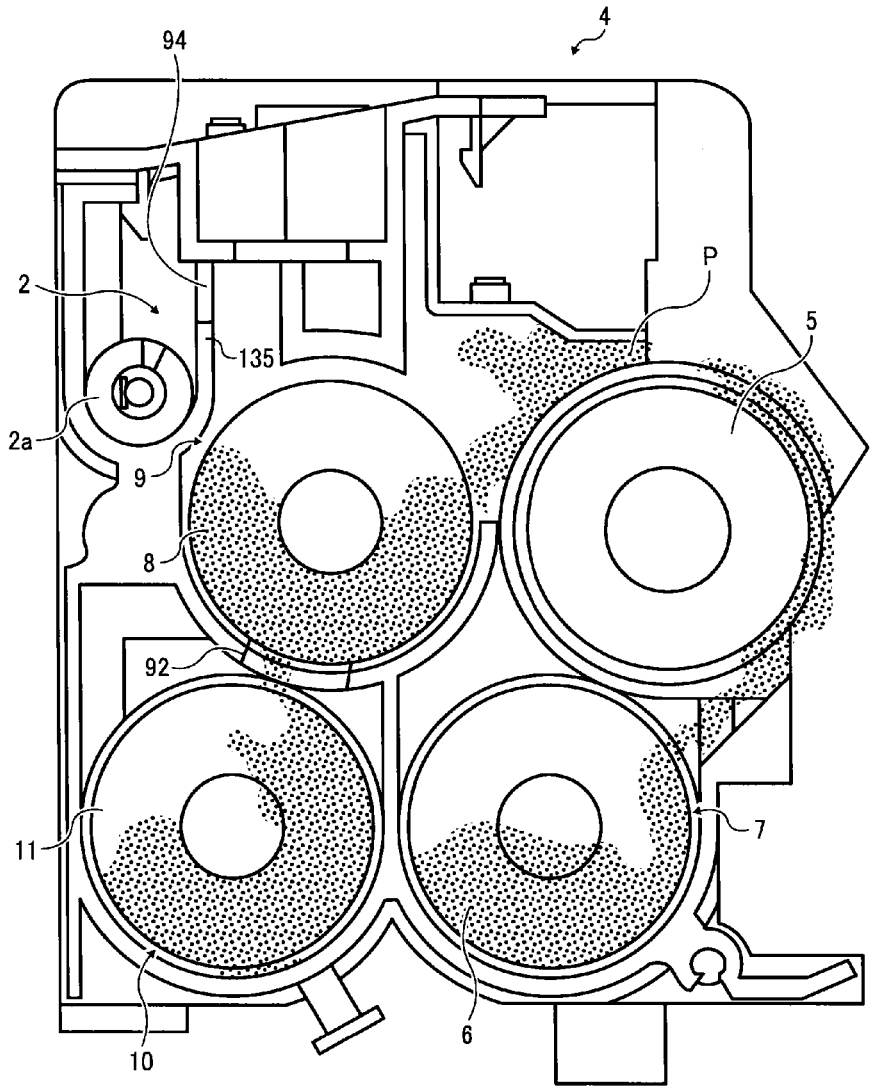
FIG. 12 is a cross-sectional view of the developing device having a small amount of developer.
Figure 13:
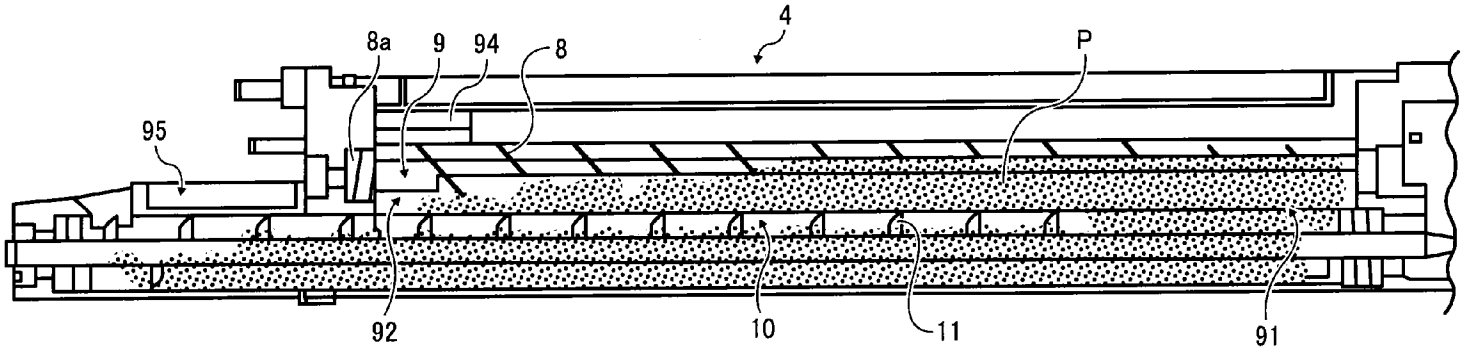
FIG. 13 is a side cross-sectional view of the developing device having a small amount of developer.

FIG. 12 and FIG. 13 each show how the developer of the developing device 4 flows when there is a small amount of developer in the developing device 4, that is, when the bulk of the developer does not reach the predetermined height level in the vicinity of the downstream end in the conveyance direction of the supply conveyance path 9. FIG. 12 shows a cross section of the developing device 4 in the vicinity of the downstream end in the conveyance direction of the supply conveyance path 9, the cross section being viewed from the same direction as FIG. 2, and FIG. 13 shows a side cross section viewed from the same direction as FIG. 5. In each of the drawings, the letter P indicates the developer.

As shown in FIG. 12 and FIG. 13, when there is a small amount of developer in the developing device 4, the developer is supplied smoothly from the supply conveyance path 9 to the stirring conveyance path 10 serving as a circulation conveyance path. As a result, the developer P does not overflow at the excess opening portion 92, which is an opening portion serving as a supply circulation communication port provided on the first partition wall 133 that is a supply circulation partition wall serving as the boundary between the supply conveyance path 9 and the stirring conveyance path 10. Therefore, most of the developer is not guided to the developer discharge port 94 that discharges the developer P to the outside of the developing device 4, whereby the developer can be prevented from being discharged when the amount of the developer is small.

Figure 14:
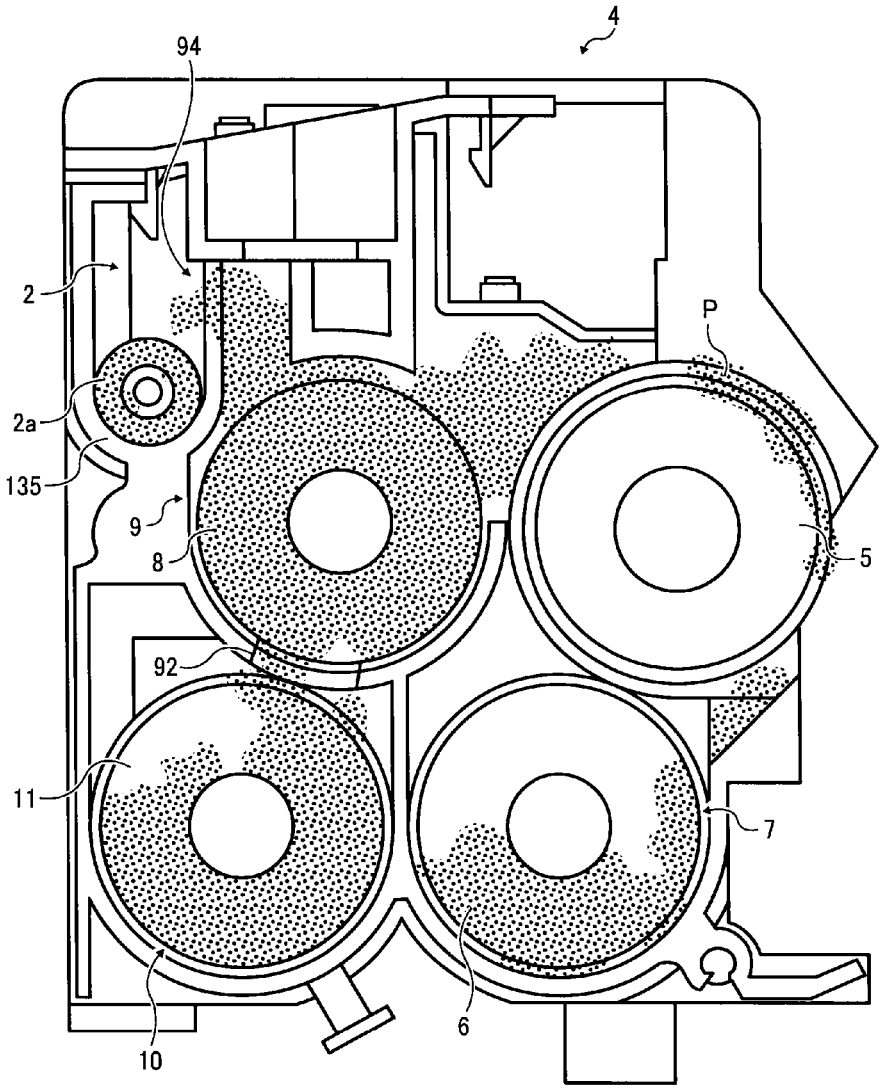
FIG. 14 is a cross-sectional view of the developing device having a large amount of developer.
Figure 15:
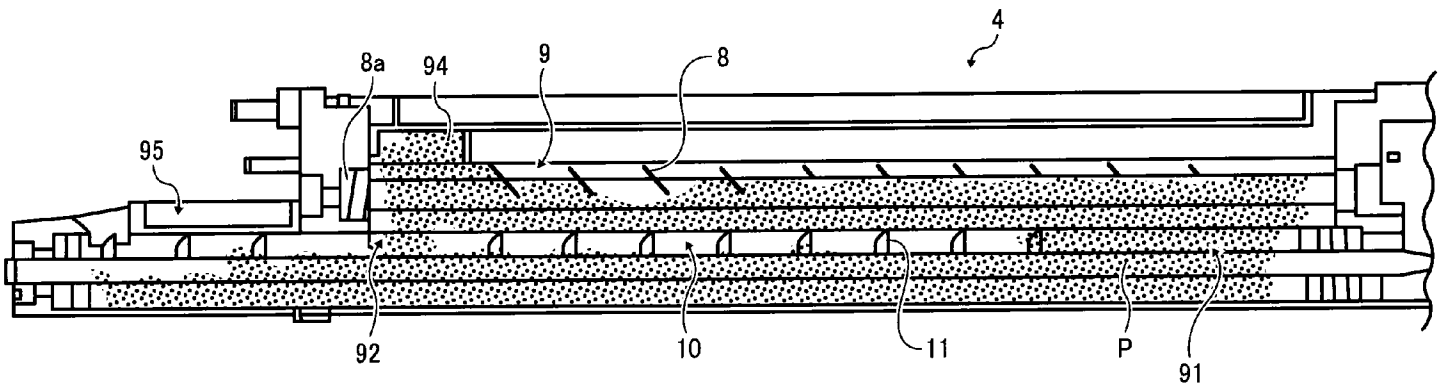
FIG. 15 is a side cross-sectional view of the developing device having a large amount of developer.

FIG. 14 and FIG. 15 each show how the developer P of the developing device 4 flows when there is a large amount of developer in the developing device 4, that is, when the bulk of the developer P exceeds the predetermined height level in the vicinity of the downstream end in the conveyance direction of the supply conveyance path 9. FIG. 14 shows a cross section of the developing device 4 in the vicinity of the downstream end in the conveyance direction of the supply conveyance path 9, the cross section being viewed from the same direction as FIG. 2, and FIG. 15 shows a side cross section viewed from the same direction as FIG. 5.

As shown in FIG. 14 and FIG. 15, when there is a large amount of developer in the developing device 4, the developer P accumulates in the vicinity of the excess opening portion 92 through which the developer P moves from the supply conveyance path 9 to the stirring conveyance path 10. As a result, the developer P existing in the lowermost stream section in the conveyance direction of the supply conveyance path 9 becomes stuck, whereby the developer bulk increases upward. When the bulk increases to the height level of the developer discharge port 94, the developer P is discharged to the developer conveyance path 2, and then to the outside of the developing device 4 by a discharge conveying screw 2*a* serving as a discharge conveying member in the discharge conveyance path 2.

In the developing device 4, when the bulk of the developer exceeds the height level of the developer discharge port 94 in the vicinity of the downstream end in the conveyance direction of the supply conveyance path 9, the developer that has reached the height level of the developer discharge port 94 is discharged. Therefore, by discharging the developer from the developer discharge port 94, the amount of developer conveyed from the supply conveyance path 9 can be prevented from being insufficient. Accordingly, a necessary amount of developer can be supplied from the supply conveyance path 9 to the developing roller 5, and then supplied from the developing roller 5 to the photoreceptor 1 stably. Consequently, the electrostatic latent image on the photoreceptor 1 can be formed into a toner image in an excellent manner, and the generation of image omission and other abnormal images is prevented so that excellent image formation can be performed.

FIG. 13 was used to describe the situation when there is a small amount of developer in the developing device 4. However, when the developer within the developing device 4 is not discharged and the amount of developer is stable, it means that the developer is accumulated in the vicinity of the downstream end in the conveyance direction of the supply conveyance path 9. Such situation will be described hereinafter in detail.

The developing device 4 is configured such that when the bulk of the developer exceeds the predetermined height level in the vicinity of the downstream end in the conveyance direction of the supply conveyance path 9, the developer discharge means discharges some of the developer. Specifically, when the bulk of the developer reaches the height level of the developer discharge port 94 in the vicinity of the downstream end in the conveyance direction of the supply conveyance path 9, the developer discharge port 94 and the discharge conveyance path 2 serving as the developer discharge means discharge the developer. Therefore, a stable amount of developer is obtained in the developing device 4 such that the developer bulk does not reach the height level of the developer discharge port 94 in the vicinity of the downstream end in the conveyance direction of the supply conveyance path 9. This is a situation in which the developer is accumulated in the vicinity of the downstream end in the conveyance direction of the supply conveyance path 9 such that the developer bulk does not reach the height level of the developer discharge port 94, due to the balance between the amount of developer conveyed from the supply conveyance path 9 to reach the downstream end in the conveyance direction thereof and the amount of developer that is delivered from the supply conveyance path 9 to the stirring conveyance path 10 via the excess opening portion 92.

In this situation, when the premixed toner is supplied by the toner replenishment control device and thereby the amount of developer within the developing device 4 increases, the amount of developer conveyed from the supply conveyance path 9 to reach the downstream end in the conveyance direction thereof becomes larger than the amount of developer delivered from the supply conveyance path 9 to the stirring conveyance path 10. At this moment, the amount of developer accumulated in the vicinity of the downstream end in the conveyance direction of the supply conveyance path 9 increases, whereby the developer bulk increases. Accordingly, when the bulk of the accumulated developer reaches the developer discharge port 94, the developer that has reached the developer discharge port 94 is discharged as part of the developer that accumulates such that the developer bulk becomes lower than the position of the developer discharge port 94.

The accumulated developer does not scatter easily, and the developer bulk changes as the amount of the developer within the developing device 4 increases or decreases. By discharging the developer when the developer bulk exceeds the predetermined height level, the increment of developer is discharged when the amount of developer within the developing device 4 increases. Therefore, the amount of developer within the developing device 4 can be maintained accurately within a predetermined range.

The amount of developer conveyed from the supply conveyance path 9 is therefore stabilized, hence the amount of developer conveyed from the supply conveyance path can be prevented from being insufficient, and a necessary amount of developer can be supplied from the supply conveyance path 9 to the developing roller 5. Therefore, the developer can be supplied stably from the developing roller 5 to the photoreceptor 1. Consequently, the electrostatic latent image on the photoreceptor 1 can be formed into a toner image in an excellent manner, and the generation of image omission and other abnormal images is prevented so that excellent image formation can be performed.

In the developing device 4, the trends of the developer vary according to the change in the amount of developer to be conveyed by the stirring screw 11 when the premixed toner is replenished and according to the amount of developer to be delivered from the stirring conveyance path 10 to the supply conveyance path 9.

For example, in the case in which the amount of developer to be conveyed by the stirring screw 11 after the premixed toner is replenished does not change significantly, the amount of developer to be supplied to the upstream side in the conveyance direction of the supply conveyance path 9 does not change. Moreover, in the case in which the amount of developer to be delivered from the stirring conveyance path 10 to the supply conveyance path 9 is close to the upper limit of the amount that can be delivered per hour in the states shown in FIG. 12 and FIG. 13, the amount of developer to be supplied to the upstream side in the conveyance direction of the supply conveyance path 9 does not change significantly. In such a case, the amount of developer within the stirring conveyance path 10 is increased by the increase in the amount of developer within the developing device 4, and the increment of the developer that moves from the stirring conveyance path to the supply conveyance path 9 per hour is lower than the increment of the developer that is supplied to the stirring conveyance path 10 per hour.

In the developing device 4 with the above configuration, even if the premixed toner is replenished, the amount of developer to be conveyed from the supply conveyance path 9 does not change, and the amount of developer to be supplied from the supply conveyance path 9 to the developing roller 5 is substantially constant, hence the amount of developer that is sent to the vicinity of the downstream end in the conveyance direction of the supply conveyance path 9 by the supply screw 8 per hour does not change much.

On the other hand, in the case in which the amount of developer to be conveyed through the stirring conveyance path 10 does not change much, the increased developer is accumulated in the vicinity of the upstream end in the conveyance direction of the stirring conveyance path 10 once the premixed toner is replenished from the toner replenishing port 95. In the case in which the amount of developer to be delivered from the stirring conveyance path 10 to the supply conveyance path 9 does not change, the increment of the developer is accumulated in the stirring conveyance path 10 and in the vicinity of the upstream end in the conveyance direction thereof.

When the developer is accumulated in the vicinity of the upstream end in the conveyance direction, the developer on the stirring conveyance path 10 blocks the excess opening portion 92 at which the developer is delivered from the supply conveyance path 9 to the stirring conveyance path 10. When the excess opening portion 92 is blocked by the developer, the developer cannot move from the supply conveyance path 9 to the stirring conveyance path 10. However, because the developer is constantly conveyed by the supply screw 8, the developer is accumulated in the vicinity of the downstream end in the conveyance direction of the supply conveyance path 9, whereby the bulk of the developer increases. Then, when the bulk of the developer accumulated in the vicinity of the downstream end in the conveyance direction of the supply conveyance path 9 increases to the height level of the developer discharge port 94, the developer P is discharged to the discharge conveyance path 2 and then to the outside of the developing device 4 through the discharge conveyance path 2.

In this configuration, when the stirring conveyance path 10 is filled with the developer, the developer overflows from the excess opening portion 92 that supplies and conveys excess developer to the stirring conveyance path 10, the excess developer being conveyed to the lowermost stream in the conveyance direction of the supply conveyance path 9 without being used for development. Accordingly, the movement of the developer from the supply conveyance path 9 to the stirring conveyance path 10 can be regulated, and as a result the stuck developer can be led to the developer discharge port 94 and discharged.

In this manner, the amount of developer to be supplied from the stirring conveyance path 10 to the supply conveyance path 9 per hour does not change significantly even if the amount of developer within the developing device 4 increases, but the developer within the developing device 4 can be replaced by disposing the developer discharge port 94 at the downstream end in the conveyance direction of the supply conveyance path 9.

Furthermore, once the premixed toner is replenished, the amount of developer to be supplied to the upstream side in the conveyance direction of the supply conveyance path 9 increases accordingly, but in some cases there is a limit to the amount of developer to be delivered from the supply conveyance path 9 to the stirring conveyance path 10. In such a configuration, the amount of developer within the supply conveyance path 9 is increased by the increase in the amount of developer within the developing device 4, and the increment of the developer that moves from the downstream end in the conveyance direction of the supply conveyance path 9 to the stirring conveyance path 10 per hour is smaller than the increment of the developer that is conveyed per hour by the supply screw 8 to the vicinity of the downstream end in the conveyance direction of the supply conveyance path 9.

In the developing device 4 having such a configuration, once the premixed toner is replenished, the amount of developer to be conveyed to the stirring conveyance path 10 increases as the amount of developer increases, and the amount of developer to be delivered from the stirring conveyance path 10 to the supply conveyance path 9 also increases. Accordingly, the amount of developer to be supplied to the upstream end portion in the conveyance direction of the supply conveyance path 9 increases, and the amount of developer to be conveyed within the supply conveyance path 9 also increases. However, because amount of developer to be supplied from the supply conveyance path 9 to the developing roller 5 does not change, the amount of developer that reaches the vicinity of the downstream end in the conveyance direction of the supply conveyance path 9 per hour increases. Also, if the amount of developer that reaches the vicinity of the downstream end in the conveyance direction of the supply conveyance path 9 per hour exceeds the upper limit of the amount of developer to be delivered from the supply conveyance path 9 to the stirring conveyance path 10 per hour, the developer is accumulated in the vicinity of the downstream end in the conveyance direction of the supply conveyance path 9, and thereby the bulk of the developer increases. When the bulk of the developer accumulated in the vicinity of the downstream end in the conveyance direction of the supply conveyance path 9 increases to the height level of the developer discharge port 94, the developer P is discharged to the discharge conveyance path 2 and then to the outside of the developing device 4 through the discharge conveyance path 2.

In this manner, even in the configuration in which the amount of developer to be supplied from the stirring conveyance path 10 to the supply conveyance path 9 per hour increases when the amount of developer within the developing device 4 increases, the developer within the developing device 4 can be replaced by disposing the developer discharge port 94 at the downstream end in the conveyance direction of the supply conveyance path 9.

Furthermore, the developer, which overflows in the vicinity of the downstream end in the conveyance direction of the supply conveyance path 9 where the developer bulk changes according to the change in the amount of developer within the developing device 4, is discharged by the developer discharge port 9 94 provided on the partition wall 135. Therefore, the developer within the developing device 4 can be replaced accurately using the simple configuration.

Moreover, there is a configuration in which the supply conveyance path 9 and the stirring conveyance path 10 serving as the circulation conveyance path are disposed adjacent to each other vertically with the first partition wall 133 serving as the supply circulation partition wall therebetween, and the developer that has reached the downstream end in the conveyance direction of the supply conveyance path 9 moves to the stirring conveyance path 10 via the excess opening portion 92 that is provided so as to communicate the supply conveyance path 9 with the stirring conveyance path 10. The bulk of the developer in the vicinity of the downstream end in the conveyance direction of the supply conveyance path 9 is changed by the difference between the amount of developer conveyed to the downstream end of the supply screw 8 by the supply screw 8 per hour and the amount of developer passing through the excess opening portion 92 per hour. The amount of developer conveyed by the supply screw 8 or the amount of developer passing through the excess opening portion 92 per hour changes as the amount of developer within the developing device 4 changes, and when the amount of developer within the developing device 4 increases, the bulk of the developer rises in the vicinity of the downstream end in the conveyance direction of the supply conveyance path 9. Therefore, the developer within the developing device 4 can be replaced accurately using the simple configuration.

Because the developer discharge port 94 and the excess opening portion 92 exist in the same position in terms of the developer conveyance direction of the supply conveyance path 9 as shown in FIG. 4, FIG. 13 and FIG. 15, the amount of developer delivered from the supply conveyance path 9 to the stirring conveyance path 10 and the amount of developer discharged to the outside of the developing device 4 can be balanced easily.

Also, because the developer discharge port 94 is disposed above the excess opening portion 92, the developer that has reached the downstream end in the conveyance direction of the supply conveyance path 9 passes only through the excess opening portion 92 below to move to the stirring conveyance path 10 and circulate in the developing device 4, when the developer exists in the developing device 4 in an appropriate amount. When the amount of developer within the developing device 4 increases and the bulk of the developer existing in the downstream end in the conveyance direction reaches the height level of the above developer discharge port 94, the developer exceeding the height level is discharged to the outside of the developing device 4 through the developer discharge port 94. In this simple configuration in which the developer discharge port 94 is disposed above the excess opening portion 92, the developer to be supplied to the stirring conveyance path 10 is prevented from being discharged to the outside of the developing device 4 before being supplied to the stirring conveyance path 10, but at the same time the developer can be discharged to the outside of the device when the amount of developer within the developing device 4 exceeds a predetermined amount. Therefore, the configuration can be realized in which the developer can be circulated via the excess opening portion 92 and the increment of the developer can be accurately discharged from the developer discharge port 94 so that the developer can be replaced.

The developing device 4 has a reversal screw portion 8*a* at the downstream end in the conveyance direction of the supply conveyance path 9, as a reversal conveying member for generating a conveying force in the direction opposite to the direction of the supply screw 8. At an end portion of the rotation axis of the supply screw 8, the reversal supply screw portion 8*a* is attached with a wing portion wound therearound in the opposite direction to the direction of the wing portion of the supply screw 8.

When the supply screw 8 rotates, the reversal screw portion 8*a* generates the conveying force in the opposite direction to the direction of the supply screw 8. Accordingly, the developer that was conveyed by the supply screw 8 and thereby has passed through the section disposed with the developer discharge port 94 and the excess opening portion 92 can be sent to the section with the developer discharge port 94 and the excess opening portion 92 by the reversal screw portion 8*a*. When the developer that has passed through the section disposed with the developer discharge port 94 and the excess opening portion 92 is further conveyed in the conveyance direction of the supply screw 8, there is a possibility that the developer enters the bearing of the rotation axis of the supply screw 8 to damage the bearing. In order to solve such a problem, the reversal screw portion 8*a* is disposed to push back the developer that has passed through the section disposed with the developer discharge port 94 and the excess opening portion 92, and, consequently, the developer can be prevented from entering the bearing, and damage of the bearing can be prevented.

Next is described a preferred positional relationship between the reversal screw portion 8*a* and the wall surface at the downstream end in the conveyance direction of the supply conveyance path 9.

Figure 16:
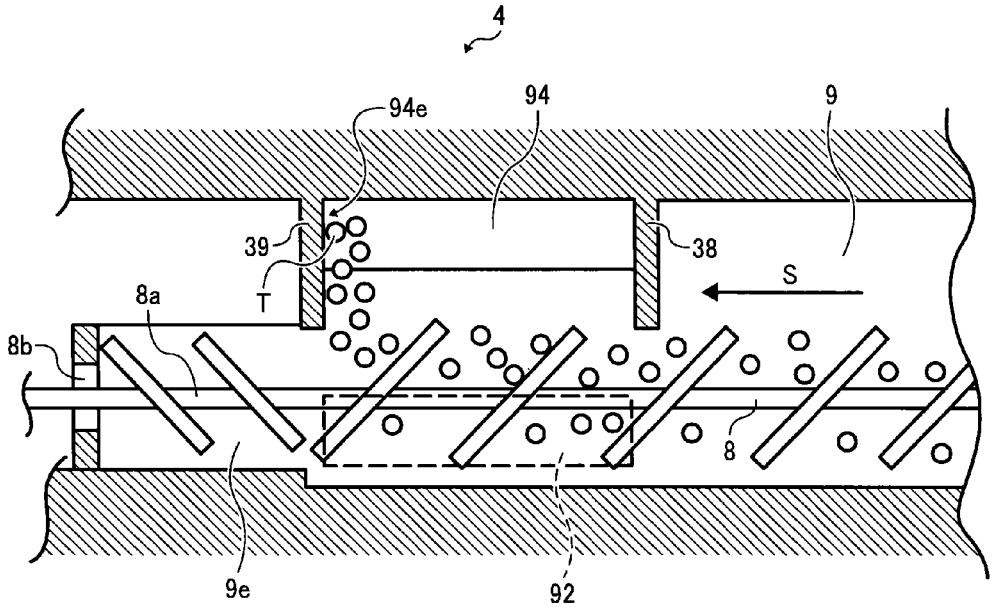
FIG. 16 is a view showing the configuration of the vicinity of a downstream end of a supply conveyance path that can be applied to the developing device of the present embodiment.

FIG. 16 shows the configuration of the vicinity of the downstream end of the supply conveyance path 9, the configuration being applicable to the developing device 4 of the present embodiment.

As shown in FIG. 16, in the boundary between the supply screw 8 serving as the supply conveying member and the reversal screw portion 8a serving as the reversal conveying member, a downstream side end surface 39 is disposed as an end surface of the downstream inside a casing forming the supply conveyance path 9. The downstream side end surface 39, which is perpendicular to the conveyance direction of the supply screw 8 and a normal line direction of which runs in the opposite direction to the conveyance direction of the supply screw 8 (direction of the arrow s in the drawing), is to prevent the developer from moving toward the downstream side in the conveyance direction of the supply screw 8 with respect to the downstream side end surface 39. There is also a wall 38.

Because developer T conveyed by the supply screw 8 is prevented from moving in the conveyance direction by the downstream side end surface 39, the conveying force weakens at the upstream of the downstream side end surface 39, and, consequently, the developer stops moving in the conveyance direction of the supply screw 8 near of the downstream side end surface 39. Specifically, the particles in the developer are moved by the conveying force of the supply screw 8 or reversal screw portion 8*a*, but the movement of the entire developer within the supply conveyance path 9 stops in the vicinity of the downstream side end surface 39. Because the developer is conveyed from the upstream side in the conveyance direction of the supply conveyance path 9 to the section where the conveying force weakens, the developer accumulates at the upstream of the downstream side end surface 39 as shown in FIG. 16, and then rises along the downstream side end surface 39. Some of the rising developer that reaches the height level of the developer discharge port 94 moves to the discharge conveyance path 2 via the developer discharge port 94 and is conveyed in the discharge conveyance path 2 and discharged to the outside of the developing device 4.

Moreover, because the developers flowing in the opposite conveyance directions collide with each other at the boundary between the supply screw 8 and the reversal screw portion 8*a*, the developer rises as with the case in which the developer conveyed by the supply screw 8 collides with the wall surface.

For this reason, by positioning the boundary between the supply screw 8 and the reversal supply screw portion 8*a* and the downstream side end surface 39 to obtain the positional relationship shown in FIG. 16, the positional relationship can assist the developer in rising along the downstream side end surface 39 so that the developer can be discharged efficiently from the developer discharge port 94. In addition, because the developer rising in the vicinity of the downstream end in the conveyance direction of the supply conveyance path 9 is discharged when the developer amount exceeds the predetermined amount, the developer can be prevented from being discharged despite that the amount of developer within the developing device 4 is not increased.

The screw pitch of the reversal screw portion 8*a* is set to be narrower than the screw pitch of the supply screw 8.

The reversal screw portion 8*a* is to prevent a bearing portion 8*b* from being damaged by the developer entering the bearing portion 8*b*. The bearing portion 8*b* is to position the axis portion of the supply screw 8 with respect to the developing device 4. If the screw pitch of the reversal screw portion 8*a* is too long, there is a possibility that the inclination of the wing portion becomes moderate, and the developer that has reached the reversal screw portion 8*a* due to the conveyance force of the supply screw 8 reaches the bearing portion 8*b* through the wing portion of the reversal screw portion 8*a*, causing damage to the bearing portion 8*b*. On the other hand, if the screw pitch of the reversal screw portion 8*a* is narrower than the screw pitch of the supply screw 8, the wing portion of the reversal screw portion 8*a* becomes approximately perpendicular to the axis portion, compared to the wing portion of the supply screw 8. By making the wing portion of the reversal screw portion 8*a* approximately vertical, the developer can be securely prevented from reaching the bearing portion 8*b*.

The developer can be accumulated at the downstream side end portion of the supply conveyance path 9 as long as it has a wall surface perpendicular to the conveyance direction of the supply screw 8. Consequently, the developer can rise along the wall surface and be discharged from the developer discharge port 94. The downstream side end portion of the supply conveyance path 9 is preferably in the form of the wall surface, in view of that the developer is discharged from the developer discharge port 94. However, by providing the bearing portion 8*b* of the supply screw 8 on the wall surface with which the developer collides, as described above, there is a possibility that the developer enters the bearing portion 8*b*, causing damage to the baring portion 8*b*. For this reason, although the reversal screw portion 8*a* is provided, the wall surface can securely allow the developer to rise. Therefore, the external diameter of the reversal screw portion 8*a* is preferably small so that the developer can be prevented from reaching the bearing portion 8*b*. By making the external diameter of the reversal screw portion 8*a* small, the diameter of a cylindrical space 9*e* provided with the reversal screw portion 8*a* can also be made small, whereby the downstream side end surface 39 can be formed wider. Therefore, by making the external diameter of the reversal screw portion 8*a* smaller than the external diameter of the supply screw 8, the lower end of the downstream side end surface 39 can be placed lower. By placing the lower end of the downstream side end surface 39 low, the developer can be allowed to rise more efficiently. Moreover, by making the external diameter of the reversal screw portion 8*a* small, the cylindrical space 9*e* can also be made small, and thus the spaces of the developing device 4 can be saved.

In the developing device 4 shown in FIG. 16, the upper end of the downstream side end surface 39 is positioned above the lower end of the developer discharge port 94. Therefore, when the amount of developer within the developing device 4 increases, the developer reaches the lower end of the developer discharge port 94 before rising along the downstream side end surface 39 to reach the upper end of the downstream side end surface 39, hence the developer can be discharged securely.

Moreover, in the developing device 4 shown in FIG. 16, a discharge port downstream end edge portion 94*e* located at the downstream end in the conveyance direction of the developer discharge port 94 exists in the same position as the downstream side end surface 39 in terms of the developer conveyance direction of the supply conveyance path 9. In this developing device 4, the downstream side end surface 39 and the planar surface corresponding to the partition wall 135 in the discharge port downstream end edge portion 94*e* of the developer discharge port 94 are formed together as a continuous planar surface with no space therebetween. Therefore, the developer rising along the downstream side end surface 39 can smoothly pass through the developer discharge port 94.

Also, in the developing device 4, the lower end of the developer discharge port 94 is positioned above the upper end of the wing portion of the supply screw 8, as shown in FIG. 16. Accordingly, in the part where the developer accumulates to reach the developer discharge port 94, the supply screw 8 is immersed in the developer so that the developer can be prevented from splashing when the supply screw 8 rotates. Therefore, the developer can be prevented from being discharged despite that the amount of developer within the developing device 4 is not increased.

In the developing device 4 that circulates the developer unidirectionally and has the supply conveyance path 9, stirring conveyance path 10 and recovery conveyance path 7, the developer that reaches the downstream end in the conveyance direction of the supply conveyance path 9 is excess developer that does not contribute to development. In the developing device 4 circulating the developer unidirectionally, it is suitable that the developer increased by replenishment of the premixed toner is discharged at the position where the excess developer accumulates. The reasons will be described hereinafter.

Because the recovery conveyance path 7 conveys the developer carried by the developer roller 5 and caused to pass through the developing region, the amount of developer conveyed within the recovery conveyance path 7 hardly changes even if the amount of developer within the developing device 4 changes. Therefore, the developer cannot be discharged due to the increase in the bulk of the developer.

In the stirring conveyance path 10, the amount of developer to be conveyed increases and thereby the bulk of the developer increases as the amount of the developer within the developing device 4 increases. However, even if the developer does not increase, the developer is discharged due to irregularities in the scattering of the developer and in the amount of developer to be conveyed, and thus there is a possibility that a necessary amount of developer cannot be delivered to the supply conveyance path 9. For this reason, it is not appropriate to discharge the developer when the bulk of the developer increases within the stirring conveyance path 10. Moreover, the configuration of discharging the developer in the middle of the supply conveyance path 9 is not appropriate because there is a possibility that the bulk of the developer increases even if the amount of developer within the developing device 4 does not increase, and thereby a shortage of the developer occurs on the downstream side in the conveyance direction rather than the position where the developer is discharged.

For these reasons, in the developing device 4 that circulates the developer unidirectionally, it is suitable that an increment of the developer obtained by replenishing the premixed toner is discharged at the position where the developer accumulates to reach the downstream end in the conveyance direction of the supply conveyance path 9.

In the developing device 4 of this embodiment, although the excess opening portion 92 has a larger opening than the developer discharge port 94, the developer discharge port 94 may have a larger opening than the excess opening portion 92.

With reference to the configuration applied to the developing device 4 shown in FIG. 4, the above embodiments have described the configuration in which when the bulk of the developer existing in the vicinity of the downstream end in the conveyance direction of the supply conveyance path 9 exceeds a predetermined height level, the developer discharge means discharges some of this developer. The configuration to which the characteristics of the present invention can be applied is not limited to the one shown in FIG. 4, and thus the characteristics of the present invention can be applied similarly to the developing device 4 having the configuration shown in FIG. 6.

Moreover, the above embodiments have described the developing device that uses, as a developer, a two-component developer consisting of carrier and toner. The developing device to which the characteristics of the present invention are applied is not limited to the developing device that uses the two-component development. A developing device that uses one-component developer can also be applied as long as it has a configuration in which the developer is replenished by the developer replenishing means and an increment of the developer within the developing device is discharged by the developer discharge means.

As described above, according to the present embodiment, when the bulk of the developer exceeds the height level of the developer discharge port 94 in the vicinity of the downstream end in the conveyance direction of the supply conveyance path 9, the developer that has reached the height level of the developer discharge port 94 is discharged to the outside of the developing device 4 by the developer discharge port 94 and discharge conveyance path 2 that serve as the developer discharge means. Therefore, by discharging the developer from the developer discharge port 94, the amount of developer conveyed from the supply conveyance path 9 can be prevented from being insufficient. Accordingly, a necessary amount of developer can be supplied from the supply conveyance path 9 to the developing roller 5, and then supplied from the developing roller 5 to the photoreceptor 1 stably. Consequently, the electrostatic latent image on the photoreceptor 1 can be formed into a toner image in an excellent manner, and the generation of image omission and other abnormal images is prevented so that excellent image formation can be performed.

Moreover, in the configuration of discharging the developer whose bulk exceeds the height level of the developer discharge port 94 in the vicinity of the downstream end in the conveyance direction of the supply conveyance path 9, the amount of the developer that moves from the stirring conveyance path 10 serving as the circulation conveyance path to the supply conveyance path 9 does not change much even if the amount of developer within the developing device 4 is increased, but the amount of the developer in the stirring conveyance path 10 increases. Accordingly, even in the configuration in which the developer accumulates in the stirring conveyance path 10 to block the excess opening portion 92 and thereby the movement of the developer from the supply conveyance path 9 to the stirring conveyance path 10 is prevented, the developer can be discharged in accordance with the increase in the amount of developer within the developing device 4.

Also, in the configuration of discharging the developer whose bulk exceeds the height level of the developer discharge port 94 in the vicinity of the downstream end in the conveyance direction of the supply conveyance path 9, the amount of the developer moving from the stirring conveyance path 10 to the supply conveyance path 9 increases as the amount of developer within the developing device 4 increases, hence the amount of the developer moving from the supply conveyance path 9 to the stirring conveyance path 10 via the excess opening portion 92 does not change much. Even in such a configuration, the developer can be discharged in accordance with the increase in the amount of developer within the developing device 4.

The developer discharge means and the supply conveyance path 9 are disposed adjacent to each other with the partition wall 135 therebetween on the downstream side in the conveyance direction of the supply conveyance path 9, and the developer discharge means is configured by the discharge conveyance path 2 that conveys the developer discharged from the supply conveyance path 9, and the developer discharge port 94 that is provided on the partition wall so as to communicate the discharge conveyance path 2 with the supply conveyance path 9. Accordingly, the developer within the developing device 4 can be replaced accurately using the simple configuration.

In addition, the supply conveyance path 9 and the stirring conveyance path 10 are disposed adjacent to each other with the first partition wall 133 serving as the supply circulation partition wall therebetween on the downstream side in the conveyance direction of the supply conveyance path 9. Also, the developer that has reached the downstream end in the conveyance direction of the supply conveyance path 9 moves to the stirring conveyance path 10 via the excess opening portion 92 serving as the supply circulation communication port provide on the first partition wall 133 so as to communicate the supply conveyance path 9 with the stirring conveyance path 10. The amount of developer conveyed by the supply screw 8 or the amount of developer passing through the excess opening portion 92 per hour changes as the amount of developer within the developing device 4 changes. Furthermore, the bulk of the developer rises in the vicinity of the downstream end in the conveyance direction of the supply conveyance path 9 as the amount of developer within the developing device 4 increases. Therefore, the developer within the developing device 4 can be replaced accurately with the simple configuration.

Because the developer discharge port 94 and the excess opening portion 92 exist in the same position in terms of the developer conveyance direction of the supply conveyance path 9, the amount of developer delivered from the supply conveyance path 9 to the stirring conveyance path 10 and the amount of developer discharged to the outside of the developing device 4 can be balanced easily.

Also, in the simple configuration where the developer discharge port 94 is disposed above the excess opening portion 92, the developer to be supplied to the stirring conveyance path 10 is prevented from being discharged to the outside of the developing device 4 before being supplied to the stirring conveyance path 10, but at the same time the developer within the developing device 4 can be discharged to the outside of the device when the amount thereof exceeds a predetermined amount. Therefore, the configuration can be realized in which the developer can be circulated via the excess opening portion 92 and the increment of the developer can be accurately discharged from the developer discharge port 94 so that the developer can be replaced.

Because the reversal screw portion 8*a* serving as the reversal conveying member is provided at the downstream end in the conveyance direction of the supply conveyance path 9 so as to generate a conveying force in the direction opposite to the direction of the supply screw 8, the developer can be prevented from entering the bearing of the rotation axis of the supply screw 8, and thereby the bearing can be prevented from being damaged.

The boundary between the supply screw 8 serving as the supply conveying member and the reversal screw portion 8*a* serving as the reversal conveying member has the downstream side end surface 39 for preventing the developer from moving in the conveyance direction. The downstream side end surface 39 is perpendicular to the conveyance direction of the supply screw 8 and a normal line direction of the downstream side end surface 39 runs in the opposite direction to the conveyance direction of the supply screw 8. Accordingly, the developer can be assisted in rising along the downstream side end surface 39 so that the developer can be discharged efficiently from the developer discharge port 94. In addition, because the developer rising in the vicinity of the downstream end in the conveyance direction of the supply conveyance path 9 is discharged when the developer exceeds the predetermined bulk, the developer can be prevented from being discharged when the amount of developer within the developing device 4 is not increased.

The supply conveying member and the reversal conveying member are the supply screw 8 and the reversal screw portion 8*a* in the form of a screw respectively, each of which has a rotation axis and a wing portion provided in a spiral form on the rotation axis and conveys the developer in the direction of rotation axis by rotating. By making the screw pitch of the reversal screw portion 8*a* shorter than that of the supply screw 8, the bearing portion 8*b* that receives the axis portion of the supply screw 8 and the reversal screw portion 8*a* can be prevented from being damaged.

In addition, the supply conveying member and the reversal conveying member are the supply screw 8 and the reversal screw portion 8*a* in the form of a screw respectively, each of which has a rotation axis and a wing portion provided in a spiral form on the rotation axis and conveys the developer in the direction of rotation axis by rotating. By making the external diameter of the wing portion of the reversal supply screw portion 8*a* smaller than that of the supply screw 8, the lower end of the downstream side end surface 39 can be placed low, and the developer can be caused to rise more efficiently.

In the developer discharge means the developer discharge port 94 for discharging the passed developer is provided in the supply conveyance path 9, and the upper end of the downstream side end surface 39 is positioned above the lower end of the developer discharge port 94. Accordingly, the developer reaches the lower end of the developer discharge port 94 before rising along the downstream side end surface 39 to reach the upper end of the downstream side end surface 39, hence the developer can be discharged securely.

In the developer discharge means the developer discharge port 94 for discharging the passed developer is provided in the supply conveyance path 9, and the position of the discharge port downstream end edge portion 94*e* of the developer discharge port 94 in terms of the conveyance direction of the supply conveyance path 9 corresponds to the position of the downstream side end surface 39 in terms of the conveyance direction of the supply conveyance path 9, the discharge port downstream end edge portion 94*e* being the downstream end in the conveyance direction of the supply conveyance path 9. Accordingly, the downstream side end surface 39 and the planar surface corresponding to the partition wall 135 in the discharge port downstream end edge portion 94*e* of the developer discharge port 94 can be formed together as a continuous planar surface with no space therebetween. Therefore, the developer rising along the downstream side end surface 39 can smoothly pass through the developer discharge port 94.

In the developer discharge means the developer discharge port 94 for discharging the passed developer is provided in the supply conveyance path 9, and the supply conveying member is the supply screw 8 in the form of a screw, which has a rotation axis and a wing portion provided in a spiral form on the rotation axis and conveys the developer in the direction of rotation axis by rotating. Also, the lower end of the developer discharge port 94 is positioned above the upper end of the wing portion of the supply screw 8. Accordingly, the developer can be prevented from splashing as the supply screw 8 rotates, and the developer can further be prevented from being discharge despite that the amount of developer within the developing device 4 is not increased.

In the developing device 4 that circulates the developer unidirectionally and has the supply conveyance path 9, stirring conveyance path 10 and recovery conveyance path 7, the developer is discharged at the position where the developer accumulates to reach the downstream end in the conveyance direction o the supply conveyance path 9. Accordingly, the developer increased by replenishment of the premixed toner can be discharged appropriately.

Moreover, by providing the developing device 4 as the developing means of the copying machine serving as the image forming apparatus, the life of the developing means can be increased by replacing the developer, and at the same time the occurrence of image omission and other abnormal images can be prevented so that excellent image formation can be performed.

[Modification 1]

Note that the developing devices 4 of the embodiment described above is configured such that the supply conveyance path 9 is disposed higher than the stirring conveyance path 10 and the recovery conveyance path 7. Such a configuration is not limited to the developing device 4 to which can be applied the configuration of saving the space in the upper part of the developing device 4 as shown in FIG. 4. Next is described Modification 1 of the developing device in which the three developer conveyance paths of the supply conveyance path 9, the stirring conveyance path 10 and the recovery conveyance path 7 are disposed at substantially the same height. Note that because the only difference between the modification and the embodiment is the shape of the developing device 4 and the rest of the configurations are identical, the developing device 4, which is the only difference, will be described.

Figure 17:
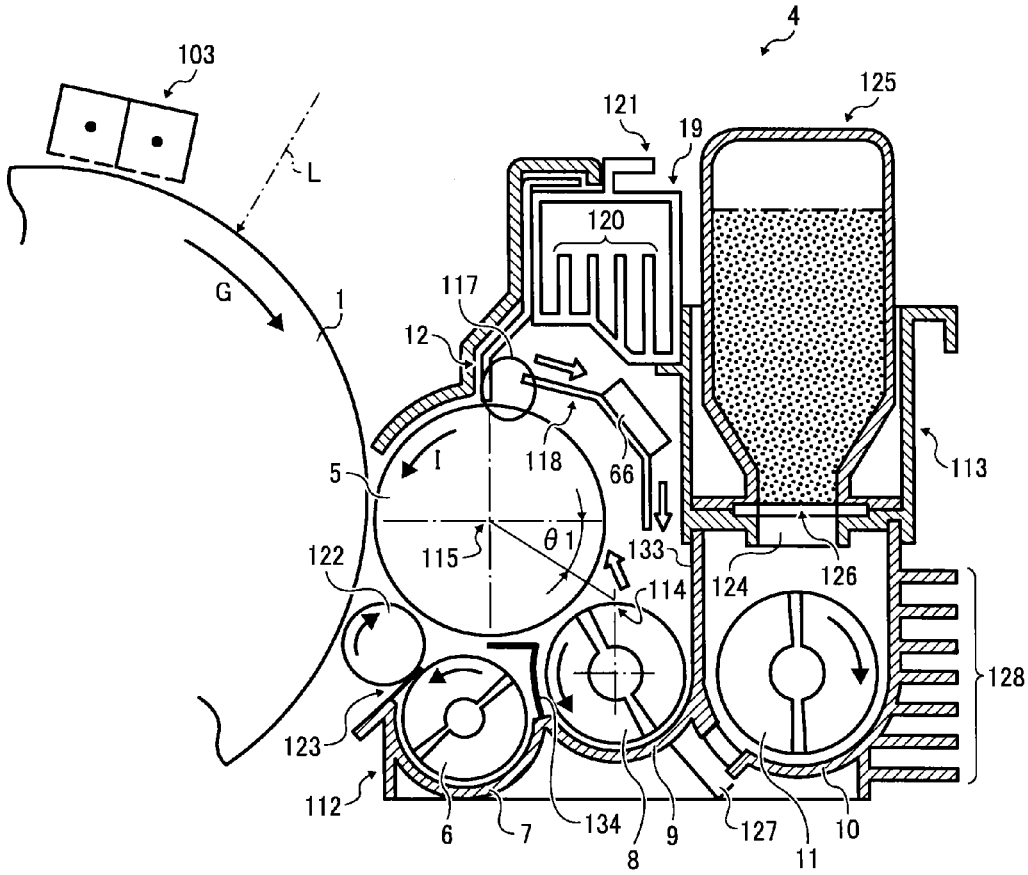
FIG. 17 is a view showing the schematic configurations of the developing device and the photoreceptor according to Modification 1 of the present embodiment.

FIG. 17 shows the schematic configuration of the developing device 4 according to Modification 1.

As shown in FIG. 17, as the photoreceptor 1 rotates in the direction of the arrow G, the surface of the photoreceptor is charged by a scorotron charger 103. On the charged surface of the photoreceptor 1, an electrostatic latent image is formed by a laser beam L irradiated from an exposure device, not shown, and the toner is supplied from the developing device 4 to the latent image, whereby a toner image is formed.

The developing device 4 has the developing roller 5 that serves as a developer carrier for supplying the toner to develop the latent image formed on the surface of the photoreceptor 1 while surface-moving in the direction of the arrow I of the drawing. The developing device 4 also has the supply screw 8 serving as a supply conveying member for, while supplying the developer to the developing roller 5, conveying the developer in the direction toward the far side of FIG. 17.

The development doctor 12 serving as a developer regulating member for regulating the thickness of the developer supplied to the developing roller 5 to a thickness suitable for development is provided on the downstream side in the direction of surface movement of the developing roller 5 from a part facing the supply screw 8.

The recovery screw 6 serving as a recovery conveying member for recovering the developer that has passed through the developing portion and used for development and for conveying the recovered recovery developer in the same direction as the direction of the supply screw 8 is provided on the downstream side in the direction of surface movement of the developing roller 5 from the developing portion which constitutes a part facing the photoreceptor 1. The supply conveyance path 9 having the supply screw 8 and the recovery conveyance path 7 having the recovery screw 6 are arranged in parallel with each other below the developing roller 5. The two conveyance paths, the supply conveyance path 9 and the recovery conveyance path 7, are partitioned by the second partition wall 134 serving as a partition member.

The stirring conveyance path 10 is provided in the developing device 4 in parallel with the opposite side of the recovery conveyance path 7 of the supply conveyance path 9. The stirring conveyance path 10 has the stirring screw 11 serving as a stirring/conveying member for, while stirring the developer, conveying it in the opposite direction to the supply screw 8, the opposite direction being oriented on the near side in the drawing. The supply conveyance path 9 and the stirring conveyance path 10 are partitioned by the first partition wall 133 serving as a partition member. An opening portion is formed on the first partition wall 133 at both ends in the near side and far side of the drawing to connect the supply conveyance path 9 and the stirring conveyance path 10 to each other. The stirring conveyance path 10 is supplied with excess developer that is supplied into the supply conveyance path 9 and conveyed to the downstream end in the conveyance direction of the supply conveyance path 9 without being used for development, and the recovery developer that is conveyed by the recovery screw 6 to the downstream end in the conveyance direction of the recovery conveyance path 7. The stirring conveyance path 10 stirs the supplied excess developer and recovery developer, and conveys them to the downstream side in the conveyance direction of the stirring screw 11. Then, the supply opening portion that is provided on the first partition wall 133 supplies the developer to the supply conveyance path 9 on the upstream side in the conveyance direction of the screw 8.

On the second partition wall 134, the end on the far side of the diagram that is located on the lowermost stream side in the conveyance direction of the recovery screw 6 is configured as an opening portion to communicate the supply conveyance path 9 with the recovery conveyance path 7. The three conveyance paths are communicated with each other at the downstream end in the conveyance direction of the recovery screw 6, the downstream end in the conveyance direction of the supply screw 8, and the upstream end in the conveyance direction of the stirring screw 11.

The recovery developer that is conveyed to the downstream end in the conveyance direction of the recovery conveyance path 7 is transported to the supply conveyance path 9. Furthermore, the recovery developer and the developer that is conveyed by the supply screw 8 but is not supplied to the developer 5 are transported to the communicated stirring conveyance path 10.

In the stirring conveyance path 10, the recovery developer, excess developer, and toner replenished from a transporting section according to need are stirred and conveyed by the stirring screw 11 in the direction opposite to that of the developer of the recovery path 7 and the supply path 9. The stirred developer is transported to the upstream side in the direction of conveyance of the supply conveyance path 9 that is communicated at the downstream side in the direction of conveyance. Note that a toner density sensor 127 is provided below the stirring conveyance path 10, and a toner replenishment control device (not shown) is actuated by the output of the sensor so that the toner is replenished from a toner bottle, not shown, to a transporting section.

The casing of the developing device 4 is configured from a lower casing 112 and an upper casing 113 that are integrally molded and divided into top and bottom parts by the axis portions of three conveying screws. The first partition wall 133 is a part of the lower casing 112, and the second partition wall 134 is held by the upper casing 113 and joined to the lower casing 112.

Note that a system using a known mohno pump can be adopted as the abovementioned toner replenishment control device. According to this system, there is no restriction in installation positions of the toner cartridge, hence this system is advantageous in terms of space allocation in the image forming apparatus. Moreover, since the toner can be replenished on a timely basis, it is not necessary to provide the developing device 4 with a large toner storage space. Therefore, the downsizing of the developing device 4 can be achieved.

As shown in FIG. 17, a screw top 114 of the supply screw 8, located in the uppermost part of the supply member, is disposed lower than a rotation center 115 of the developing roller 5. In the developing device 4, the angle θ1 between the straight line connecting the rotational centre 115 of the developing roller 5 to the screw top 114 and the horizontal straight line passing through the rotation center 115 is set to 30 [°]. The angle θ1 changes according to the diameter of the supply screw 8, but it is preferably set to 10 [°] through 40 [°] in terms of the layout in order to achieve the downsizing of the developing device 4.

The developer is supplied to the developing roller 5 because a magnetic pole provided within the developing roller 5 attracts the magnetic carrier contained in the developer. As described above, the screw top 114 is disposed lower than the rotation center 115 of the developing roller 5, hence the magnitude of the magnetic force contributes to the amount of developer supplied to the developing roller, without having an effect of the weight of the developer on the amount of developer supplied to the developing roller 5. Accordingly, the developer to be conveyed by the supply conveyance path 9 is securely supplied from above the developer, and thus an appropriate amount of developer can be supplied to the developing roller 5 even if the bulk of the developer within the supply conveyance path 9 is not uniform in the conveyance direction of the supply screw 8.

In the developing device in which the conventional three developer conveyance paths are disposed at the same height, the supply opening portion for delivering the developer from the stirring conveyance path 10 to the supply conveyance path 9 was provided outside the developing region width. Therefore, compared to the developing roller 5 and the recovery conveyance path 7, the upstream end portions in the conveyance directions of the stirring conveyance path 10 and the supply conveyance path 9 protrude largely.

In the developing device 4 of Modification 1, because the supply opening portion is provided within the developing region width, such protrusions of the stirring conveyance path 10 and the supply conveyance path 9 that are greater than those of the developing roller 5 and the recovery conveyance path 7 are eliminated, hence the space saving of the developing device 4 can be achieved.

In addition, in the developing device 4 of Modification 1, because the recovery conveyance path 7, the stirring conveyance path 10 and the supply conveyance path 9 are disposed at substantially the same height, stress placed on the developer can be alleviated so that the life of the developer can be increased. Specifically, by disposing the three developer conveyance paths at the same height, the developer does not have to be lifted up in the developer conveyance paths, hence the stress placed on the developer can be alleviated. Accordingly, developer deterioration can be prevented, and stable image quality can be maintained.

[Modification 2]

In the above-described embodiment, the developer discharge port 94 is disposed in the vicinity of the downstream end in the conveyance direction of the supply conveyance path 9 and, when the developer existing in the vicinity of the downstream end in the conveyance direction of the supply conveyance path 9 exceeds a predetermined bulk, some of this developer is discharged. The position of the developer discharge port 94 is not limited to the vicinity of the downstream end of the supply conveyance path 9.

There may be provided the developer conveyance amount regulating means for regulating the amount of developer passing through the regulating position in the developer conveyance paths including the supply conveyance path 9, stirring conveyance path 10 and recovery conveyance path 7, so that the developer is regulated by the developer conveyance amount regulating means, and the developer discharge port 94 may be disposed such that when the amount of the accumulated developer exceeds a predetermined amount, the developer is discharged from the developer discharge port 94. The developer conveyance amount regulating means can include a conveyance amount regulating member for narrowing the middle of one conveyance path to regulate the amount of passing developer, and the excess opening portion 92.

In the above-described embodiment, the excess opening portion 92 functions as the developer conveyance amount regulating means so that, depending on the size of the excess opening portion 92, the amount of developer passing through the excess opening portion 92 and delivered from the supply conveyance path 9 to the stirring conveyance path 10 can be regulated. When the developer that is regulated at the time of deliver and then accumulates in the vicinity of the downstream end in the conveyance direction of the supply conveyance path 9 exceeds a predetermined amount and a predetermined height level, the developer is discharged from the developer discharge port 94 so as to obtain the predetermined amount of developer.

As Modification 2, next is described a configuration in which the developer discharge port 94 is provided in a section other than the vicinity of the downstream end of the supply conveyance path 9.

Figure 18:
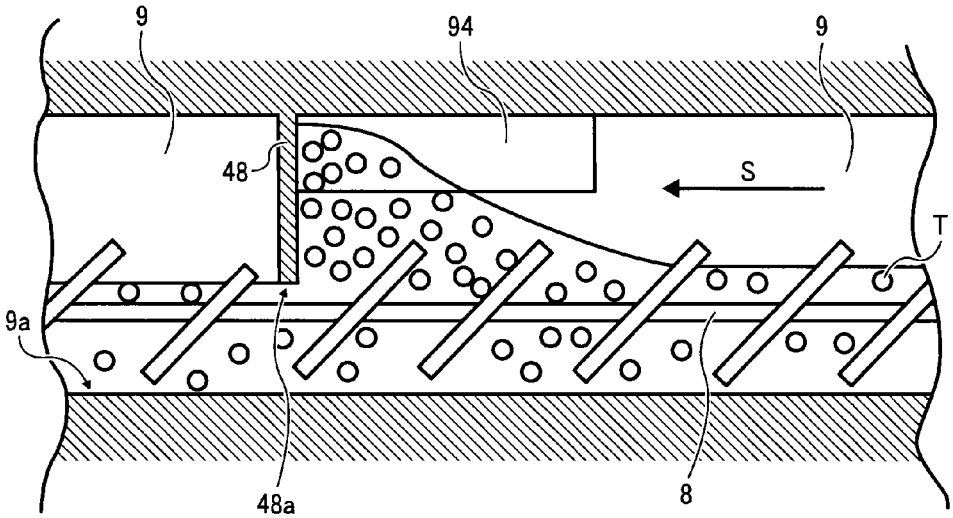
FIG. 18 is a schematic diagram for explaining Modification 2 of the present embodiment in which a conveyance amount regulating wall is provided in the supply conveyance path.

FIG. 18 is a schematic diagram of the configuration of Modification 2 in which a conveyance amount regulating wall 48 is provided in the middle of the supply conveyance path 9, as the regulating member for narrowing the middle of one conveyance path to regulate the amount of passing developer.

In the supply conveyance path 9 shown in FIG. 18, there is formed a regulating portion, the cross-sectional area of which between a regulating member leading end portion 48*a* in a lower end portion of the conveyance amount regulating wall 48 and a bottom surface 9*a* of the supply conveyance path 9 is smaller than any other part of the supply conveyance path 9. The regulating portion is for regulating the amount of passing developer. When the developer reaches the upstream side of the conveyance amount regulating wall 48 in an amount larger than the amount of developer that can pass through the regulating portion per hour, the developer exceeding the amount that can pass through the regulating portion cannot pass through the regulating portion and accumulates on the upstream side of the regulating portion. The conveyance amount regulating wall 48 is provided such that it protrudes from the upper surface of the supply conveyance path 9 toward the downstream of the developer discharge port 94, and the developer regulated by the conveyance amount regulating wall 48 accumulates on the upstream side of the wall surface of the conveyance amount regulating wall 48. Then, the amount of the developer accumulated on the upstream side of the regulating portion increases as the amount of developer within the developing device 4 increases. When this developer accumulates to the amount so as to reach the developer discharge port 94, the developer starts to be discharged. The height level for disposing the developer discharge port 94 and the size of the opening of the same are defined so that when the accumulated developer that reaches a predetermined amount can be discharged therefrom.

In this manner, the height level and width of the developer discharge port 94 are set so that the developer regulated by the conveyance amount regulating member 48 and accumulated is discharged from the developer discharge port 94. Accordingly, the amount of developer within the developing device 4 becomes stable when there exists the developer that has not increased to reach the height level of the developer discharge port 94 in the vicinity of the regulating position. Unlike the developer that constantly moves, the accumulated developer does not scatter easily, and thus the amount of the accumulated developer changes appropriately in accordance with the increase or decrease in the amount of developer within the developing device 4. Therefore, in Modification 2 for discharging the accumulated developer, the developer within the developing device 4 can be secured in a necessary amount.

Modification 2 has described the configuration in which the conveyance amount regulating member 48 is provided in the middle of the supply conveyance path 9, but the position to provide the conveyance amount regulating member 48 is not limited to the middle of the supply conveyance path 9, and thus it can be provided in a section where the bulk of the developer to be conveyed changes in accordance with the increase or decrease in the amount of developer within the developing device 4.

As described above, according to the present invention, the developer, which exists in the vicinity of the downstream end in the conveyance direction of the supply conveyance path where the less-scattering developer accumulates, is discharged. Accordingly, the scattered developer is prevented from being discharged, and the developer can be prevented from being discharged despite that the amount of developer within the developing device is not increased. Therefore, the present invention has the excellent effects that the developer within the developing device can be secured in a necessary amount, and that the developer can be supplied stably from the developer carrier to the latent image carrier.

Moreover, according to the present invention, the developer, which is regulated by the developer conveyance amount regulating means, accumulated, and thereby prevented from scattering, is discharged. Accordingly, the scattered developer is prevented from being discharged, and the developer can be prevented from being discharged despite that the amount of developer within the developing device is not increased. Therefore, the present invention has the excellent effects that the developer within the developing device can be secured in a necessary amount, and that the developer can be supplied stably from the developer carrier to the latent image carrier.

Various modifications will become possible for those skilled in the art after receiving the teachings of the present disclosure, without departing from the scope thereof.

What is claimed is:

1. A developing device, comprising:

a developer carrier, which rotates while carrying a developer on a surface thereof, supplies a toner to a latent image on a surface of a latent image carrier at a section where the developer carrier faces the latent image carrier, and develops the latent image;

a supply conveyance path, which has a supply conveying member that conveys the developer in an axis line direction of the developer carrier while supplying the developer to the developer carrier;

a circulation conveyance path, which has a circulation conveying member that conveys the developer reaching a downstream end in a conveyance direction of the supply conveyance path to an upstream in the conveyance direction of the supply conveyance path;

a developer discharge port for discharging part of the developer existing in the vicinity of the downstream end in the conveyance direction of the supply conveyance path to an exterior of the developing device, when the bulk of the developer existing in the vicinity of the downstream end in the conveyance direction of the supply conveyance path exceeds a predetermined height level; and a recovery conveyance path, which has a recovery conveying member that conveys the developer recovered from the developer carrier after passing through the section where the developer carrier faces the latent image carrier, in the axis line direction of the developer carrier and in the same direction as the direction of the supply conveying member, the recovery conveying member conveying toner to the circulation conveying member.

2. The developing device as claimed in claim 1, further comprising:

a discharge conveyance path, which is disposed adjacent to the supply conveyance path on a downstream side in the conveyance direction of the supply conveyance path with a partition wall therebetween, and conveys the developer discharged from the supply conveyance path, wherein:

the developer discharge port is an opening provided at a predetermined height level of the partition wall so as to communicate the discharge conveyance path and the supply conveyance path with each other, the developer discharge port discharging the developer reaching the height level of the developer discharge port from the developer discharge port to the discharge conveyance path.

3. The developing device as claimed in claim 2, wherein the supply conveyance path and the circulation conveyance path are disposed adjacent to each other with a supply circulation partition wall therebetween, and the supply circulation partition wall at the downstream end in the conveyance direction of the supply conveyance path is provided with a supply circulation communication port as an opening portion for communicating the supply conveyance path and the circulation conveyance path with each other, so that the developer reaching the downstream end in the conveyance direction of the supply conveyance path moves to the circulation conveyance path via the supply circulation communication port.

4. The developing device as claimed in claim 3, wherein the developer discharge port exists in the same position as the supply circulation communication port in terms of a developer conveyance direction of the supply conveyance path.

5. The developing device as claimed in claim 3, wherein the developer discharge port is disposed higher than the supply circulation communication port.

6. The developing device as claimed in claim 1, further comprising:

a two-component developer comprising toner and magnetic carrier, as the developer; and wherein the circulation conveyance path is a stirring conveyance path, which is supplied with the developer conveyed to the lowermost stream side in the conveyance direction of the supply conveyance path without being used for development, and supplied with the developer conveyed to the lowermost stream side in a conveyance direction of the recovery conveyance path, has a stirring conveying member as the circulation conveying member for, while stirring the developer, conveying the developer in the axis line direction of the developer carrier and in a direction opposite to the direction of the supply conveying member, and supplies the stirred developer to the supply conveyance path.

7. A developing device, comprising:

a developer carrier, which rotates while carrying a developer on a surface thereof, supplies a toner to a latent image on a surface of a latent image carrier at a section where the developer carrier faces the latent image carrier, and develops the latent image;

a supply conveyance path, which has a supply conveying member that conveys the developer in an axis line direction of the developer carrier while supplying the developer to the developer carrier;

a circulation conveyance path, which has a circulation conveying member that conveys the developer reaching a downstream in a conveyance direction of the supply conveyance path to an upstream end in the conveyance direction of the supply conveyance path;

a developer discharge port for discharging part of the developer existing in the vicinity of the downstream end in the conveyance direction of the supply conveyance path, when the bulk of the developer existing in the vicinity of the downstream end in the conveyance direction of the supply conveyance path exceeds a predetermined height level;

a recovery conveyance path, which has a recovery conveying member that conveys the developer recovered from the developer carrier after passing through the section where the developer carrier faces the latent image carrier, in the axis line direction of the developer carrier and in the same direction as the direction of the supply conveying member, the recovery conveying member conveying toner to the circulation conveying member; and a reversal conveying member which generates a conveying force in a direction opposite to the direction of the supply conveying member at the end of the lowermost stream in the developer conveyance direction of the supply conveyance path.

8. The developing device as claimed in claim 7, further comprising, at a boundary between the supply conveying member and the reversal conveying member, a downstream end wall surface, which is perpendicular to the conveyance direction of the supply conveying member, a normal line direction of which is opposite to the conveyance direction of the supply conveying member, and which prevents the developer from moving in the conveyance direction.

9. The developing device as claimed in claim 8, wherein the supply conveying member and the reversal conveying member are a supply screw and a reversal screw in the form of a screw respectively, each of which has a rotation axis and a wing portion provided in a spiral form on the rotation axis and conveys the developer in a direction of the rotation axis by rotating, the reversal screw having a shorter screw pitch than the supply screw.

10. The developing device as claimed in claim 8, wherein the supply conveying member and the reversal conveying member are a supply screw and a reversal screw in the form of a screw respectively, each of which has a rotation axis and a wing portion provided in a spiral form on the rotation axis and conveys the developer in a direction of the rotation axis by rotating, the wing portion of the reversal screw having a smaller external diameter than the supply screw.

11. The developing device as claimed in claim 8, wherein an upper end of the downstream end wall surface is located higher than a downstream end of the developer discharge port.

12. The developing device as claimed in claim 8, wherein a position of a discharge port downstream end edge portion serving as the downstream end in the conveyance direction of the supply conveyance path at the developer discharge port in terms of the conveyance direction of the supply conveyance path corresponds to the position of the downstream end wall surface in terms of the conveyance direction of the supply conveyance path.

13. The developing device as claimed in claim 8, wherein the supply conveying member is a supply screw in the form of a screw, which has a rotation axis and a wing portion provided in a spiral form on the rotation axis and conveys the developer in a direction of the rotation axis by rotating, and the lower end of the developer discharge port is located higher than an upper end of the wing portion of the supply screw.

14. An image forming apparatus, comprising;

at least a latent image carrier;

charging means for charging a surface of the latent image carrier;

latent image forming means for forming an electrostatic latent image on the latent image carrier; and developing means for developing the electrostatic latent image to form a toner image, wherein the developing means comprises:

a developer carrier, which rotates while carrying a developer on a surface thereof, supplies a toner to a latent image on a surface of a latent image carrier at a section where the developer carrier faces the latent image carrier, and develops the latent image;

a supply conveyance path, which has a supply conveying member that conveys the developer in an axis line direction of the developer carrier while supplying the developer to the developer carrier;

a circulation conveyance path, which has a circulation conveying member that conveys the developer reaching a downstream end in a conveyance direction of the supply conveyance path to an upstream in the conveyance direction of the supply conveyance path;

a developer discharge port for discharging part of the developer existing in the vicinity of the downstream end in the conveyance direction of the supply conveyance path, when the bulk of the developer existing in the vicinity of the downstream end in the conveyance direction of the supply conveyance path exceeds a predetermined height level, the developer discharge port for discharging developer to an exterior of the developing means; and a recovery conveyance path, which has a recovery conveying member that conveys the developer recovered from the developer carrier after passing through the section where the developer carrier faces the latent image carrier, in the axis line direction of the developer carrier and in the same direction as the direction of the supply circulation member, the recovery conveying member conveying toner to the supply circulation conveying member.

15. A developing device, comprising:

a developer carrier, which rotates while carrying a developer on a surface thereof, supplies a toner to a latent image on a surface of a latent image carrier at a section where the developer carrier faces the latent image carrier, and develops the latent image;

a supply conveyance path, which has a supply conveying member that conveys the developer in an axis line direction of the developer carrier while supplying the developer to the developer carrier;

a circulation conveyance path, which has a circulation conveying member that conveys the developer reaching a downstream end in a conveyance direction of the supply conveyance path to an upstream in the conveyance direction of the supply conveyance path;

developer conveyance amount regulating means for regulating the amount of the developer that passes through a developer discharge port for discharging part of the developer within developer conveyance paths which include the supply conveyance path and circulation conveyance path to the outside of the developer conveyance paths, and for regulating the amount of the developer through regulating positions within the developer conveyance paths, the developer discharge port for discharging developer to an exterior of the developing device; and a recovery conveyance path, which has a recovery conveying member that conveys the developer recovered from the developer carrier after passing through the section where the developer carrier faces the latent image carrier, in the axis line direction of the developer carrier and in the same direction as the direction of the circulation conveying member, the recovery conveying member conveying toner to the supply circulation member, wherein the developer discharge port is disposed such that accumulated developer that is regulated by the developer conveyance amount regulating means is discharged from the developer discharge port when the amount of the accumulated developer exceeds a predetermined amount.

* * * * *